US008752308B2

(12) United States Patent
Strong

(10) Patent No.: US 8,752,308 B2
(45) **Date of Patent: *Jun. 17, 2014**

(54) FOOTWEAR HAVING AIR-CONTROLLED ACTIVE ELEMENT

(76) Inventor: Finn Alexander Strong, San Rafael, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/588,035

(22) Filed: Aug. 17, 2012

(65) Prior Publication Data

US 2013/0081191 A1 Apr. 4, 2013

Related U.S. Application Data

(63) Continuation of application No. 13/333,462, filed on Dec. 21, 2011, now Pat. No. 8,266,828.

(60) Provisional application No. 61/429,177, filed on Jan. 2, 2011, provisional application No. 61/528,100, filed on Aug. 26, 2011.

(51) Int. Cl.

| | |
|---|---|
| ***A43B 3/30*** | (2006.01) |
| ***A43B 13/20*** | (2006.01) |
| ***A63H 3/06*** | (2006.01) |
| ***A41D 27/08*** | (2006.01) |
| ***A43B 13/04*** | (2006.01) |
| ***A43B 3/00*** | (2006.01) |
| ***A43B 23/24*** | (2006.01) |
| ***F15B 15/18*** | (2006.01) |
| ***F15B 15/10*** | (2006.01) |

(52) U.S. Cl.

CPC ..... *A41D 27/08* (2013.01); *A43B 13/04* (2013.01); *A43B 3/0078* (2013.01); *A43B 13/203* (2013.01); *A43B 23/24* (2013.01); *F15B 15/18* (2013.01); *F15B 15/10* (2013.01)

USPC ..... 36/112; 36/29; 36/136; 446/183; 446/185; 446/221

(58) Field of Classification Search

USPC ..... 36/112, 29, 136, 3 B; 446/183, 185, 446/221, 199, 337, 338, 341, 342, 346

See application file for complete search history.

(56) References Cited

U.S. PATENT DOCUMENTS

| | | | |
|---|---|---|---|
| 1,560,073 | A | 11/1925 | Bontempi et al. |
| 2,673,349 | A | 3/1954 | Key |

(Continued)

FOREIGN PATENT DOCUMENTS

| | | |
|---|---|---|
| KR | 20-1994-0021732 | 10/1994 |
| KR | 20-2000-0002938 | 2/2000 |

(Continued)

OTHER PUBLICATIONS

"MONTY PYTHON Rabbit w/Big Pointy Teeth Plush Slippers" —http://www.toyvault.com/topfive/topfive.html, printed Dec. 21, 2011, product asserted to be available 2001.

*Primary Examiner* — Ted Kavanaugh

(74) *Attorney, Agent, or Firm* — Patent Law Offices of Michael E. Woods; Michael E. Woods

(57) ABSTRACT

A clothing article for a foot including a sole including a sealed collapsible air cavity having disposed therein a return support for expanding a collapsed air cavity wherein the air cavity includes an outlet permitting a quantity of air to exit when the air cavity is collapsed; an upper, coupled to the sole, for covering a portion of the foot; an air-actuated active element coupled to the upper, the active element including a first mode and a second mode, the active element biased to the first mode and responsive to the quantity of air to transition from the first mode to the second mode; and a communication channel, coupled to the outlet and to the active element, for transferring the quantity of air from the air cavity to the active element.

39 Claims, 29 Drawing Sheets

(56) References Cited

U.S. PATENT DOCUMENTS

| | | | | |
|---|---|---|---|---|
| 2,721,420 | A | | 10/1955 | Chatten |
| 2,803,015 | A | | 8/1957 | Milone |
| 3,047,879 | A | | 8/1962 | Spreiregen |
| 3,125,827 | A | | 3/1964 | Ostrander |
| 3,141,261 | A | | 7/1964 | Mirando |
| 3,186,126 | A | | 6/1965 | Ostrander |
| 3,237,344 | A | | 3/1966 | Ostrander |
| 3,340,846 | A | | 9/1967 | Magiera |
| 3,451,160 | A | | 6/1969 | Ryan et al. |
| 3,501,144 | A | | 3/1970 | Schmidt |
| 3,738,024 | A | | 6/1973 | Matsuda |
| 3,740,893 | A | | 6/1973 | Shinoda |
| 3,882,631 | A | | 5/1975 | Goldfarb et al. |
| 4,009,528 | A | | 3/1977 | Villari, Jr. et al. |
| 4,057,928 | A | | 11/1977 | Terzian |
| 4,067,138 | A | | 1/1978 | Cederholm et al. |
| 4,124,952 | A | | 11/1978 | Terzian |
| 4,217,725 | A | | 8/1980 | Sapkus et al. |
| 4,218,780 | A | | 8/1980 | Growe et al. |
| 4,287,681 | A | | 9/1981 | Albert et al. |
| 4,324,005 | A | | 4/1982 | Willis |
| 4,669,997 | A | | 6/1987 | Kulesza et al. |
| 4,759,737 | A | | 7/1988 | Ferenczi |
| 4,828,526 | A | | 5/1989 | Schneider et al. |
| 4,845,865 | A | | 7/1989 | Chang et al. |
| D328,179 | S | | 7/1992 | Barker |
| 5,129,106 | A | | 7/1992 | Liou |
| D336,543 | S | | 6/1993 | Murray, III et al. |
| 5,243,707 | A | | 9/1993 | Bodinet |
| 5,257,470 | A | * | 11/1993 | Auger et al. ..... 36/88 |
| 5,259,070 | A | | 11/1993 | De Roza |
| 5,285,585 | A | | 2/1994 | Baker |
| 5,325,539 | A | | 7/1994 | Kronenberger |
| 5,353,525 | A | * | 10/1994 | Grim ..... 36/88 |
| 5,564,201 | A | | 10/1996 | O'Connell |
| D410,318 | S | | 6/1999 | Chen |
| 6,094,742 | A | | 8/2000 | Gattamorta |
| 6,389,604 | B1 | | 5/2002 | Day |
| 6,439,950 | B1 | | 8/2002 | Goldman et al. |
| 6,672,932 | B1 | | 1/2004 | Panec et al. |
| 6,681,504 | B2 | | 1/2004 | Kinan |
| 6,881,119 | B2 | | 4/2005 | Panec et al. |
| 6,889,451 | B2 | * | 5/2005 | Passke et al. ..... 36/29 |
| 7,451,555 | B1 | | 11/2008 | Lakic |
| 8,105,129 | B2 | | 1/2012 | Chen |
| 8,266,828 | B2 | | 9/2012 | Strong |
| 8,327,462 | B2 | | 12/2012 | Feldman et al. |
| 8,505,116 | B2 | | 8/2013 | Strong |
| 2003/0084593 | A1 | | 5/2003 | Lakic |
| 2003/0135914 | A1 | | 7/2003 | Racine et al. |
| 2004/0003452 | A1 | | 1/2004 | Schiebl |
| 2004/0226078 | A1 | | 11/2004 | Lahman et al. |
| 2005/0223601 | A1 | | 10/2005 | Dabah |
| 2012/0167270 | A1 | | 7/2012 | Strong |
| 2013/0160188 | A1 | | 6/2013 | Strong |

FOREIGN PATENT DOCUMENTS

| | | | |
|---|---|---|---|
| KR | 1020040039214 | A | 5/2004 |
| KR | 20-0369494 | | 12/2004 |
| KR | 20-0437670 | | 12/2007 |
| KR | 2020100005134 | U | 5/2010 |
| KR | 2020110008364 | U | 8/2011 |
| WO | 2012092152 | A2 | 7/2012 |

* cited by examiner

FOOTWEAR HAVING AIR-CONTROLLED ACTIVE ELEMENT

CROSS REFERENCE TO RELATED APPLICATIONS

This application is a continuation of U.S. patent application Ser. No. 13/333,462, filed Dec. 21, 2011, now U.S. Pat. No. 8,266,828, which claims benefit of both U.S. Provisional Application No. 61/429,177, filed 2 Jan. 2011, and U.S. Provisional Application No. 61/528,100, filed 26 Aug. 2011, the contents in their entireties expressly incorporated by reference thereto for all purposes.

COPYRIGHT OF INVENTION

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The present invention relates generally to amusement systems, and more specifically to amusement clothing having an air-actuated active element responsive to wearer action.

People, particularly, children and young adults, have an interest in amusement systems. Even more so when those amusement systems are colorful and include one or more user-actuable active elements incorporated into an article of clothing. It is desirable to provide a wide variety amusement systems in order to maintain an interest and freshness by their users.

What is needed is an improved amusement system including one or more user-actuable active elements.

BRIEF SUMMARY OF THE INVENTION

Disclosed is an improved amusement system and method including one or more user-actuable active elements that are able to be installed into articles of clothing. In preferred embodiments, the operator (e.g., the wearer) is able to actuate the amusement system in response to everyday actions. For example, for a footwear-based amusement system, simply walking actuates the amusement system. The amusement system are also preferably installed to support a thematic context of the system or structure into which it is installed. For example, the article of clothing may implement a "bird" theme and the amusement system serves as an engine for a moveable element of the clothing that ties into the bird theme (e.g., a pair of wings that flap with each actuation), with many different themes and corresponding active element(s) possible. The preferred embodiments of the present invention include air-powered amusement systems and methods, and particularly such amusement systems incorporated into clothing and most specifically to amusement systems incorporated into plush thematic footwear.

An air-powered actuator system includes a first air cavity wherein the first air cavity includes a first capacity for a first quantity of air and includes an outlet permitting a portion of the first quantity of air to exit when the first air cavity is collapsed; an air-actuated active element, remotely located relative to the air cavity, including a second air cavity having a second capacity for a second quantity of air, the active element including a first mode having the second air cavity substantially deflated and a second mode having the second air cavity at least partially inflated, wherein the air-actuated active element transitions from the first mode to the second mode responsive to the portion of air entering into the second air cavity and wherein the active element is pliant in the first mode and wherein the active element is rigid in the second mode; and an elongate communication channel, coupled to the outlet and to the active element, transferring the portion of air from the first air cavity to the second air cavity.

A method for operating an air-powered actuator system, the method including (a) collapsing repeatedly a first air cavity, each collapse expelling a portion of a first quantity of air contained within the first air cavity; and (b) expanding repeatedly the first air cavity; and (c) initiating, responsive to each the collapsing step (a), a transfer of each portion of air into a second air cavity included within an air-actuated active element, each the portion of air flowing through a flexible conduit connecting the first air cavity to the second air cavity with the portion of air flowing into the second air cavity beginning a transition of the air-actuated active element from a biasedly-closed first mode towards an open second mode, the first mode having the second air cavity substantially deflated and the second mode having the second air cavity at least partially inflated.

A footwear article includes a sole including a first air cavity wherein the first air cavity includes a first capacity for a first quantity of air and includes an outlet permitting a portion of the first quantity of air to exit when the first air cavity is collapsed; an upper, coupled to the sole, covering a portion of a foot of a wearer; an air-actuated active element, coupled to the upper, including a second air cavity having a second capacity for a second quantity of air, the active element including a first mode having the second air cavity substantially deflated and a second mode having the second air cavity at least partially inflated, wherein the air-actuated active element transitions from the first mode to the second mode responsive to the portion of air entering into the second air cavity and wherein the active element is pliant in the first mode and wherein the active element is rigid in the second mode; and an elongate communication channel, coupled to the outlet and to the active element, transferring the portion of air from the first air cavity to the second air cavity.

A method for operating an air-powered footwear article worn on a foot of a wearer, the footwear article including a collapsible and expandable air cavity within a sole of the footwear article wherein the air cavity is biased into an expanded mode and wherein the air cavity collapses responsive to a compressive force applied by the foot, the method including a) collapsing the air cavity responsive to the wearer weighting the sole to expel a quantity of air from the air cavity; b) communicating the quantity of air expelled from the air cavity to an air-actuated active element coupled to the sole, the active element including a first mode and a second mode, the active element biased to the first mode and responsive to the quantity of air to transition from the first mode to the second mode; c) transitioning the active element from the first mode to the second mode responsive to the wearer weighting the sole; and d) transitioning the active element from the second mode to the first mode responsive to the wearer unweighting the sole.

The disclosed system and method provide a flexible architecture for creating a wide range of active amusement devices and processes. When incorporated into clothing such as footwear, taking steps while worn actuates air-activated elements with each step, catching the attention and imagination of the wearer. For clothing, particularly plush clothing, and more particularly for plush active thematic footwear for children, it is desirable to provide rugged, resilient, inexpensive, and non-rigid solutions that can provide extended cycle-times under a wide-range of operating conditions. The air-powered amusement systems and sub-systems detailed herein may be adapted to other uses and is not limited to clothing uses. A doll or the like may include active elements actuated, such as by squeezing or otherwise compressing a principal air cavity. Other features and benefits of the present invention are realized upon a review of the present application, including the specification, figures, and claims thereof.

BRIEF DESCRIPTION OF THE DRAWINGS

FIG. 1 illustrates an exploded perspective view of a first fanciful air-powered active footwear article;

FIG. 2 illustrates plan views of components of an air-powered active footwear article such as the types described herein;

FIG. 3 illustrates side and front plan views of a second fanciful air-powered active footwear article, components, and operation;

FIG. 4 illustrates front plan views of the fanciful air-powered active footwear articles shown in FIG. 1 and FIG. 3 and their operation;

FIG. 5 illustrates front plan views of a pair of differently themed fanciful air-powered active footwear articles and their operation;

FIG. 6 illustrates front plan views of a pair of differently themed fanciful air-powered active footwear articles and their operation;

FIG. 7 illustrates front plan views of a pair of differently themed fanciful air-powered active footwear articles and their operation;

FIG. 8 illustrates front plan views of a pair of differently themed fanciful air-powered active footwear articles and their operation;

FIG. 9 illustrates a left hand and a right hand view of a rotating air-powered accessory for use with a themed fanciful air-powered active footwear article described herein;

FIG. 10 illustrates a side plan view of a representative fanciful air-powered active footwear article;

FIG. 11 illustrates a series of side plan views of an operational sequence for a first type of air-powered actuator for use with a themed fanciful air-powered active footwear article described herein;

FIG. 12 illustrates a series of side plan views of an operational sequence for a second type of air-powered actuator for use with a themed fanciful air-powered active footwear article described herein;

FIG. 13 illustrates a series of side plan views of an operational sequence for a third type of air-powered actuator for use with a themed fanciful air-powered active footwear article described herein;

FIG. 14 illustrates a top plan for the polymeric hinge used in FIG. 13;

FIG. 15 illustrates a top plan for a fourth type of air-powered actuator for use with a themed fanciful air-powered active footwear article described herein;

FIG. 16 illustrates a series of side plan views of an operational sequence for a fifth type and a sixth type of air-powered actuators for use with a themed fanciful air-powered active footwear article described herein;

FIG. 17 illustrates a series of side plan views of an operational sequence for a seventh type and an eighth type of air-powered actuators for use with a themed fanciful air-powered active footwear article described herein;

FIG. 18 illustrates front perspective views of representative examples of themed fanciful air-powered active footwear articles implementing the present invention;

FIG. 19 illustrates a front perspective view of a puppy-themed fanciful air-powered active footwear article in a relaxed mode;

FIG. 20 illustrates a front perspective view of the puppy-themed fanciful air-powered active footwear article of FIG. 19 in an actuated mode;

FIG. 21 illustrates a front perspective view of a dog-themed fanciful air-powered active footwear article in a relaxed mode;

FIG. 22 illustrates a front perspective view of the dog-themed fanciful air-powered active footwear article of FIG. 21 in an actuated mode;

FIG. 23 illustrates a front perspective view of a one-eyed monster-themed fanciful air-powered active footwear article in a relaxed mode;

FIG. 24 illustrates a front perspective view of the one-eyed monster-themed fanciful air-powered active footwear article of FIG. 23 in an actuated mode;

FIG. 25 illustrates a front perspective view of a unicorn-themed fanciful air-powered active footwear article in a relaxed mode;

FIG. 26 illustrates a front perspective view of the unicorn-themed fanciful air-powered active footwear article of FIG. 25 in an actuated mode;

FIG. 27 illustrates a front perspective view of a reptile-themed fanciful air-powered active footwear article in a relaxed mode;

FIG. 28 illustrates a front perspective view of the reptile-themed fanciful air-powered active footwear article of FIG. 27 in an actuated mode;

FIG. 29 illustrates a front perspective view of a bunny-themed fanciful air-powered active footwear article in a relaxed mode;

FIG. 30 illustrates a front perspective view of the bunny-themed fanciful air-powered active footwear article of FIG. 27 in an actuated mode;

FIG. 35 illustrates a pair of side plan views of a dinosaur-themed fanciful air-powered active footwear article in a relaxed mode and an actuated mode and further illustrates a front perspective view of the dinosaur-themed fanciful air-powered active footwear article in the actuated mode;

FIG. 36 illustrates a pair of side plan views of a sea monster-themed fanciful air-powered active footwear article in a relaxed mode and an actuated mode and further illustrates a front perspective view of the sea monster-themed fanciful air-powered active footwear article in the relaxed mode;

FIG. 37 illustrates a front perspective view of a fish-themed fanciful air-powered active footwear article in a relaxed mode and a side plan view of the fish-themed fanciful air-powered active footwear article in an actuated mode.

DETAILED DESCRIPTION OF THE INVENTION

Figure 1:
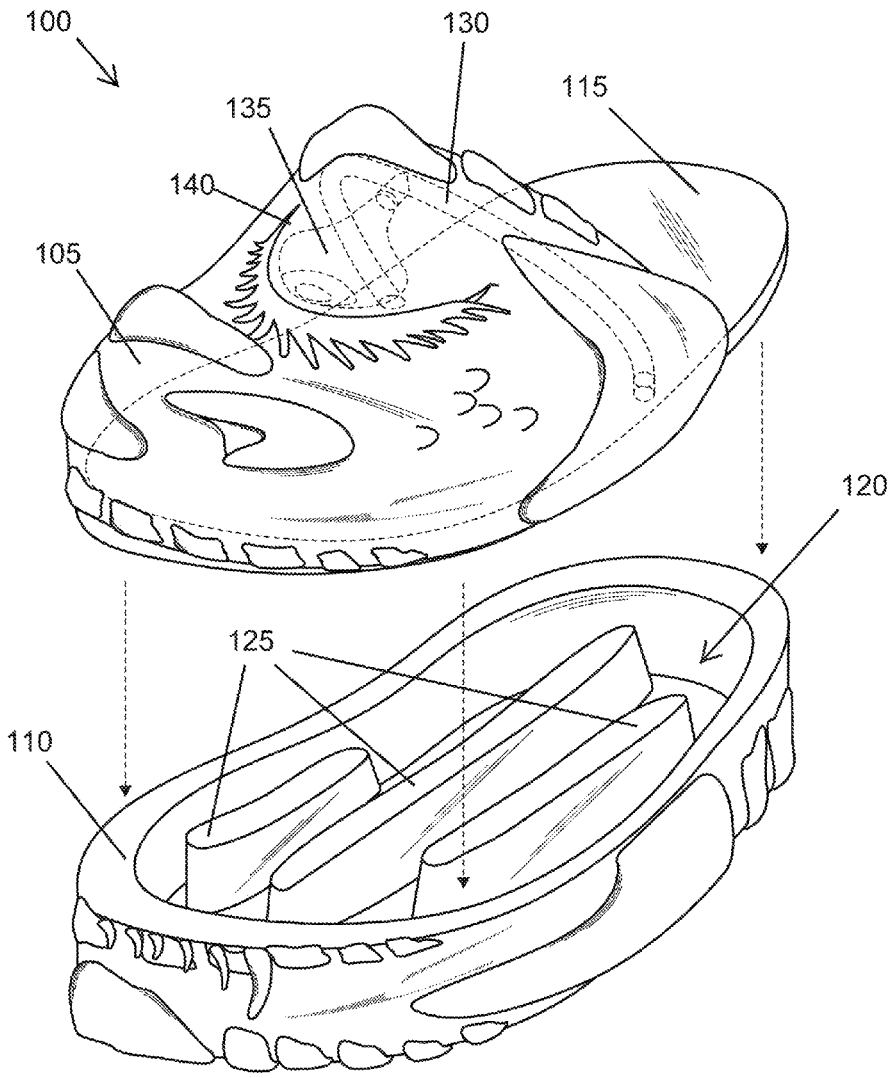
FIG. 1-FIG. 9 are various views of preferred embodiments of the present invention.

The present invention relates to apparatus, systems, and methods for an improved amusement architecture and processes including one or more user-actuable active elements. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

FIG. 1-FIG. 9 are various views of preferred embodiments of the present invention.

The present invention relates to an improved amusement system and method including one or more user-actuable active elements, particularly for children and young adults. Many different types of air-actuated structures (e.g., opening, flapping, rotating, spinning, erecting, unrolling, flipping, blowing, unfurling, expanding, and the like) are responsive to expulsion of air from one or more air cavities. For example, there may be a "dragon-headed" embodiment in which a tongue unrolls out of the dragon's mouth with every down-step and re-rolls into the mouth with every up-step.

The cavities may be provided as part of a closed system (the quantity of air contained within the system is moved from one portion to another) or open (the quantity of air is expelled and then replenished), or combinations (partially expelled and partially contained). For these open/partially open systems, a quantity of air needed for replenishment may be provided through an exit valve or through a specially-prepared inlet valve, or combinations thereof.

These air-actuated structures are biased in a first mode, the quantity of air transitioning elements/components of the structures to a second mode, responsive to the user collapsing the air cavity (e.g., stepping down on a sole containing the cavity, kicking an object when the cavity is in a toe-protector or the like). The cavity may be disposed across the entire bottom of the sole, or in just a portion (a front part (e.g., pad) or a back part (e.g., a heel)). In some instances, there may be multiple air cavities present in each article of footwear, independently controlling one or more air-actuated structures with each foot. Stepping on the pad of the foot actuates one element and stepping on the heel actuates another element (or the cavities may be separated down the length of the foot (e.g., left side vs. right side)). See, for example, FIG. 33 and FIG. 34 described herein. In some embodiments, audio elements controlled by quantities of air from one or more cavities may be added as well.

Some of the disclosed embodiments include one or more explicit return supports to "re-inflate" the air cavity. A necessity or desirability of such a return support depends on several factors, including the materials and construction used for the air cavity. For example, an air bladder that has a thick wall with enough "shape memory" will re-inflate without an additional return support. Another possibility is an air bladder with accordion/bellow-like vertical sides that act like return springs. The air cavity may be formed by sealing an open volume between airtight layers, or it may be explicitly defined by a bladder, balloon, or the like. Balloon is sometimes used herein, and unless the context provides otherwise, balloon is used in a broad sense of a gas-filled bag and is not limited to bags with elastomeric walls that expand appreciably when filled with gas.

To improve responsiveness, it is sometimes desirable that the air-actuated structures include a biasing feature to help quickly return them to an un-actuated mode. These biasing features may be discrete elements (e.g., springs, memory materials and the like), or integrated elements provided due to the arrangement or type of materials used in formation. Solutions in which multiple features are designed-in without separate component cost or assembly requirement help to reduce the cost and enable a more widespread adoption. Thus some of the embodiments and features described herein are focused on performance-enhancing and damage-resisting features that also reduce cost.

For an amusement system most preferably, but not exclusively, designed to be incorporated into a plush thematic article of clothing (e.g., a footwear article) to be worn and operated by children, low cost, enhanced performance, and resistance to damage are all important features. These features are often adversely related in that reducing cost can, without care, decrease performance and lower damage resistance. Purposeful design to counter this adverse relationship underlies some of the embodiments of the present invention. One aspect of preferred embodiments of the present invention includes recognition of this relationship designs to provide an air-powered system that anticipates formation of air-leaks and that is resistant catastrophic failure in the event certain leaks occur.

One primary vector for potential damage of a footwear article includes the scenario wherein a wearer rapidly jumps up and down while wearing the footwear article. The jumping forcefully and repetitively expels air from an air cavity. The repetitive movement of a large quantity of air at near maximum pressure can make a system otherwise unprepared for such situations prone to bursting. The bursting unfortunately often results in actuators that fail to actuate, dramatically decreasing their amusement function, and thus value of the embodiments. Preferred embodiments of the present invention strategically incorporate one-way and bleed vents, among other features, to help ameliorate such situations.

FIG. 1 illustrates an exploded perspective view of a first fanciful air-powered active footwear article 100. Footwear article 100, as in other footwear articles described herein, may be implemented in many different styles and incorporate many different themes, and need not be constrained for use in a "slipper" type article with the theme shown in FIG. 1. Footwear article 100 includes an upper 105 coupled to a sole that includes an outsole 110 and an insole 115. A bladder 120 or air reservoir is defined in outsole 110 by forming a cavity and sealing it to insole 115 (in other embodiments, bladder 120 is a separate discrete structure disposed in, or otherwise coupled to the sole to be responsive to stepping or weighting/unweighting of footwear article 100). Without a separate discrete bladder 120, outsole 110 and insole 115 are made of closed cell or other air-impermeable material. Outsole 110 further includes a number of optional resilient biasing structures 125 that compress when the cavity is collapsed by application of a stepping force and which expand to help reform the cavity when the stepping force is removed. In this way, the cavity collapses and is reformed with each weighting and un-weighting of a footstep or the like. Bladder 120 expels the quantity of air every time that the cavity is collapsed. Bladder 120 intakes the quantity of air every time that the cavity is reformed and thereby refills itself. In a "leaky" system, at least some of the refilling air is received from ambient air surrounding footwear article 100. In a closed system, the air is substantially moved from one location to another.

A conduit 130 is coupled into bladder 120 and couples the quantity of air to an actuator 135. Conduit 130 is preferred to be implemented as an elongate communication channel, such as a non-kinking air hose but other types of conduit and air channel may be used to direct the quantity of air from bladder 120 to actuator 135. In many of the preferred embodiments, actuator 135 is coupled to upper 105. In the preferred embodiments, footwear article 100 includes a fanciful theme for amusement, particularly for amusement at least partially derived from the theme and by including an active (e.g., a moving) element consistent with that theme. The motion is preferably initiated and controlled responsive to air effect coupled from bladder 120 to actuator 135 via conduit 130. The motion is most preferably implemented to include a component, coupled to actuator 135, that is revealed during an actuation mode and is concealed during a de-actuation mode. Footwear article 100 alternates between the actuation mode and the de-actuation mode as the wearer steps down (i.e., weights bladder 120) and steps up (i.e., un-weights bladder 120).

Footwear article 100 is shown with an "eyeball" component that is coupled to actuator 135. Conduit 130 and actuator 135 (including the eyeball) are shown in broken lines indicating that they are concealed, at least part of the time. Conduit 130 is preferably always hidden within upper 105 while the eyeball is revealed during the actuation mode and is re-concealed during the subsequent de-actuation mode. In footwear article 100, a flap 140 is hingedly coupled to upper 105 to permit the eyeball to be alternatively revealed and hidden during actuations and de-actuations respectively.

The preceding describes the basics of the structures and operation of footwear articles of the preferred embodiments described herein. Quality and features of the "active" characteristic of footwear article 100 are improved by additional features that result in quicker, fuller responses to weightings, that reduce any tendency to damage (e.g., burst) bladder 120 and/or actuator 135, and that enable these enhanced features to be implemented inexpensively. For example, one performance metric relates to how quickly and fully actuator 135 responds to a "step" or the like. Provision in the preferred embodiments of a bleed-valve improves performance and reduces damage risks as further described herein. The bleed-valve enables the quantity of air displaced from bladder 120 to be greater than a minimum necessary for actuation of actuator 135 (which means in some instances that partial steps will fully actuate actuator 135). Any extra quantity of air is able to be safely diverted through the bleed vent and reduces air pressures which can increase damage risks. Another performance metric includes a time for actuator 135 to "reset" itself (i.e., return to de-actuation mode). Less desirable options include taking too long to reset and/or only partially reset before an attempt to re-actuate is made. One feature that helps in the reset is to provide biasing mechanisms that help to deflate actuator 135. Adding flap 140 and attaching it to upper 105 adds a biasing mechanism that uses gravity to aid in the deflation. An additional problem addressed in a leaky system is that without care, the successive stepping and unstepping can result in "pumping up" actuator 135 so it becomes unresponsive. A strategically placed bleed-valve as described herein is one mechanism to reduce occurrences of this phenomenon.

While the preferred embodiments resist pressure-induced degradation, as one of the goals is to reduce costs, it is possible that some pressure-induced degradation will occur somewhere in the bladder, conduit, or air-powered actuator. This degradation will sometimes appear as a leak in the system, and proper positioning of a refill mechanism (e.g., a one-way valve) helps to ensure complete and rapid refilling of bladder 120.

Figure 2:
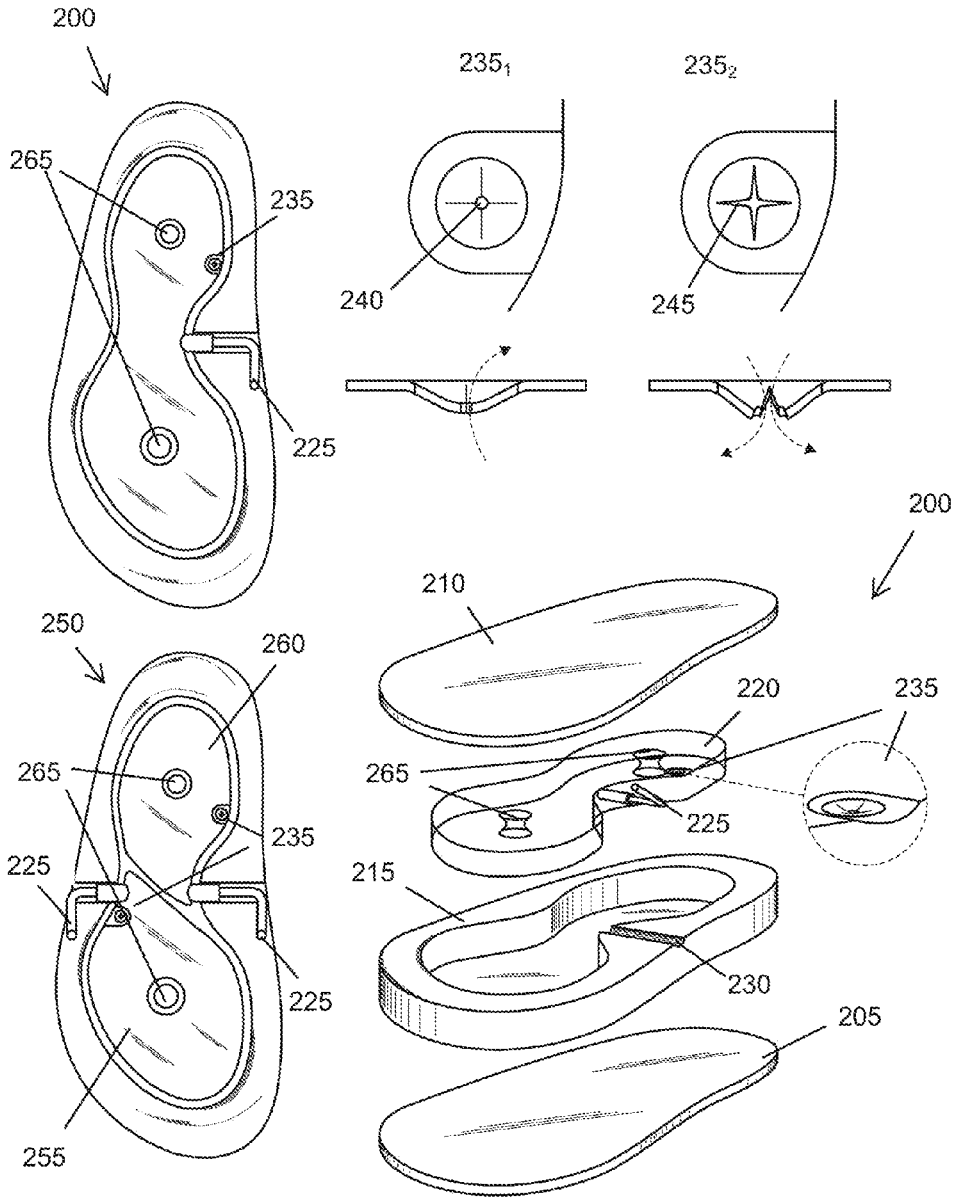

FIG. 2 illustrates plan views of components of an air-powered active footwear article such as the types described herein. A bladder assembly 200 includes an outer sole 205, a top sole 210, an air-bladder casing 215 containing an air-bladder 220. Outer sole 205 and top sole 210 are secured to air-bladder casing 215 to secure air-bladder 220 within. A conduit 225 is communicated to air-bladder 220 and passes through a recess 230 in air-bladder casing 215. Optionally included in air-bladder 220 are one or more valves 235. Valves 235 preferably are a type of one-way valve, in this case they allow quick intake and slow release of air into and out of, respectively, air-bladder 220. Valve 235 is, in a preferred embodiment, a simple cross-cut in a molded air-bladder 220. An optional small hole 240 coupled with a cross cut 245 (for example placed at a bottom of a concave divot) allows for variable airflow control. Valve $\mathbf{235}_1$ in a closed mode has optional small hole 240 for slow release. Valve $\mathbf{235}_2$ in an open mode has a larger aperture (e.g., open cross-cut 245) for increased air intake. In some implementations, cross cut 245 may be placed on a top wall of air-bladder 220 near top sole 210. Providing a layer of open cell foam or other air-permeable material overlying cross cut 245 located in this way provides one implementation of a one-way valve. The user stepping on top sole 210 overlying cross cut 245 effectively seals the valve which inhibits release of air through cross cut 245. A subsequent unweighting of top sole 210 releases cross cut 245 and permits air to flow into air-bladder 220.

An alternative bladder assembly 250 includes the features of bladder assembly 200 except that air bladder casing 215 accommodates a pair of independent air bladders (a forward air bladder 255 and a rear air bladder 260), each having a conduit 225. In some cases, one or more optional holes 265 may be used for extra structure and inflation of the air-bladder (e.g., air bladder 220).

Figure 3:
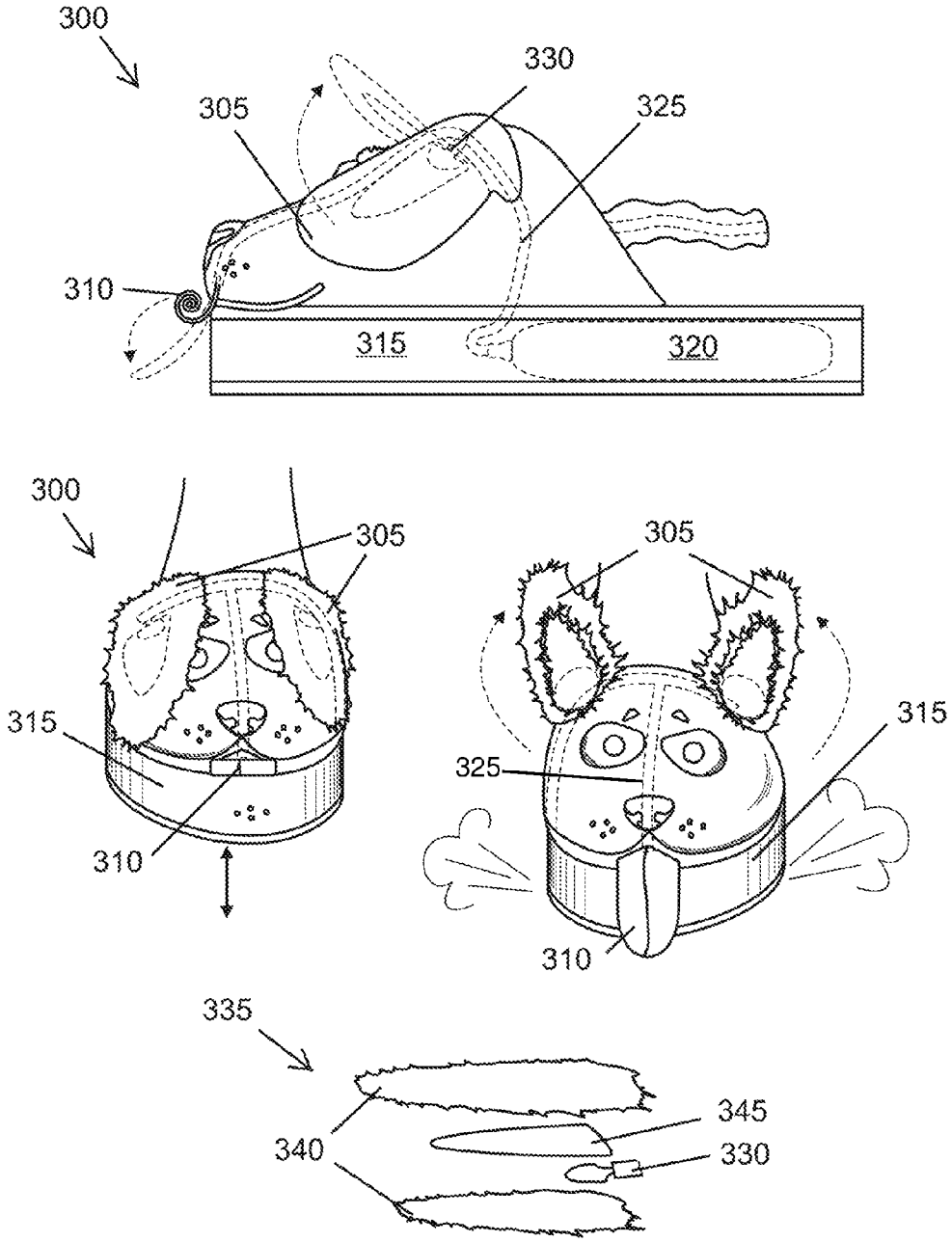

FIG. 3 illustrates side and front plan views of a second fanciful air-powered active footwear article 300, components, and operation thereof. Footwear article 300 is configured similarly to footwear article 100 with a different theme and different theme actuation. Footwear article 300 includes a "puppy" theme and the theme actuation includes a pair of ears 305 that fly up and a tongue 310 that extends (e.g., unrolls). Footwear article 300 includes sole 315 encasing a bladder 320 that contains a quantity of air. Compressing bladder 320 directs the quantity of air through a conduit 325 to a plurality of actuators 330 (one actuator 330 for each moveable element, such as each ear and tongue in this particular theme actuation). An ear assembly 335, such as may be used for an ear 305, illustrates that an ear actuator 330 is disposed between a pair of fabric layers 340 and a stiff actuating element support 345 that enables inflation of ear actuator 330 to move the pair of fabric layers 340 by amplifying the actuation motion.

Figure 4:
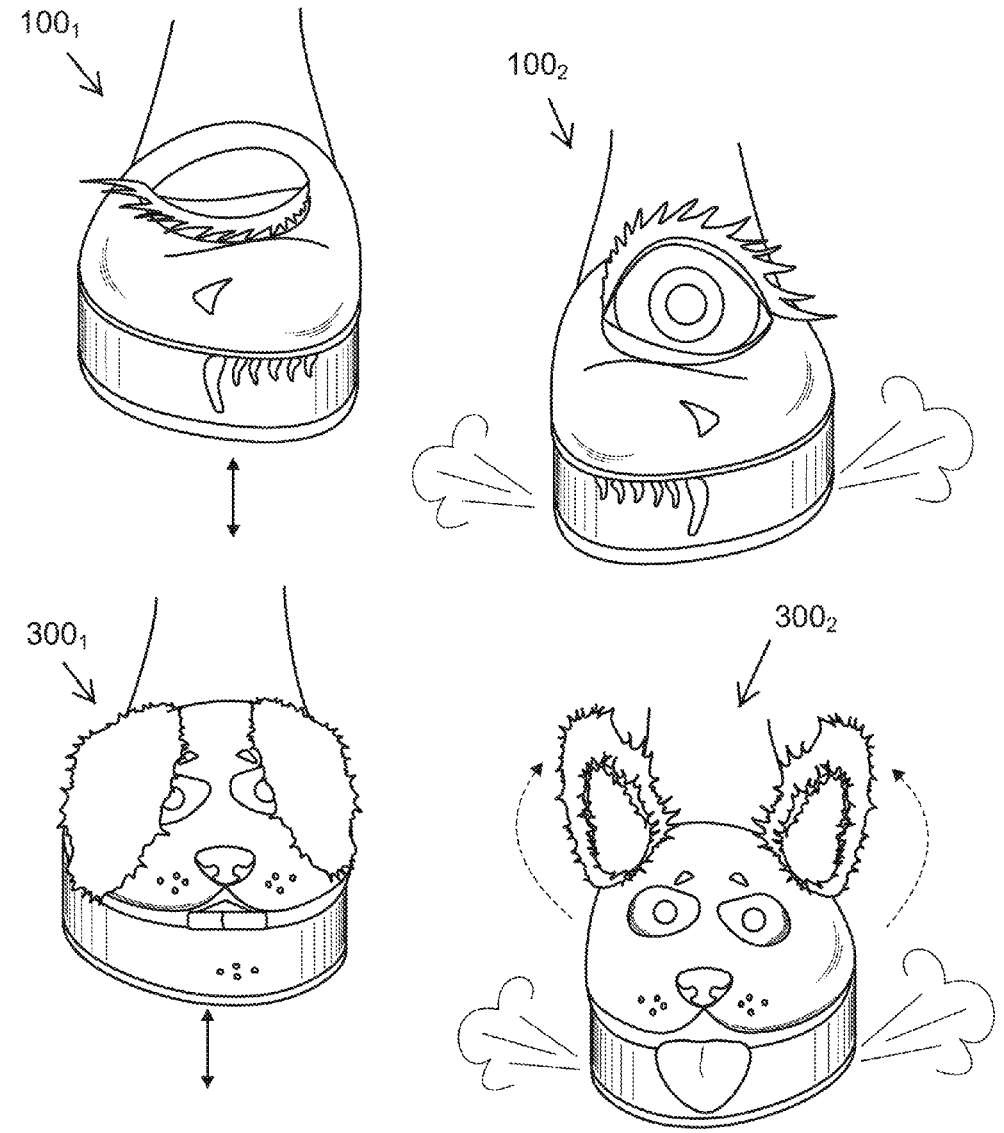
Figure 5:
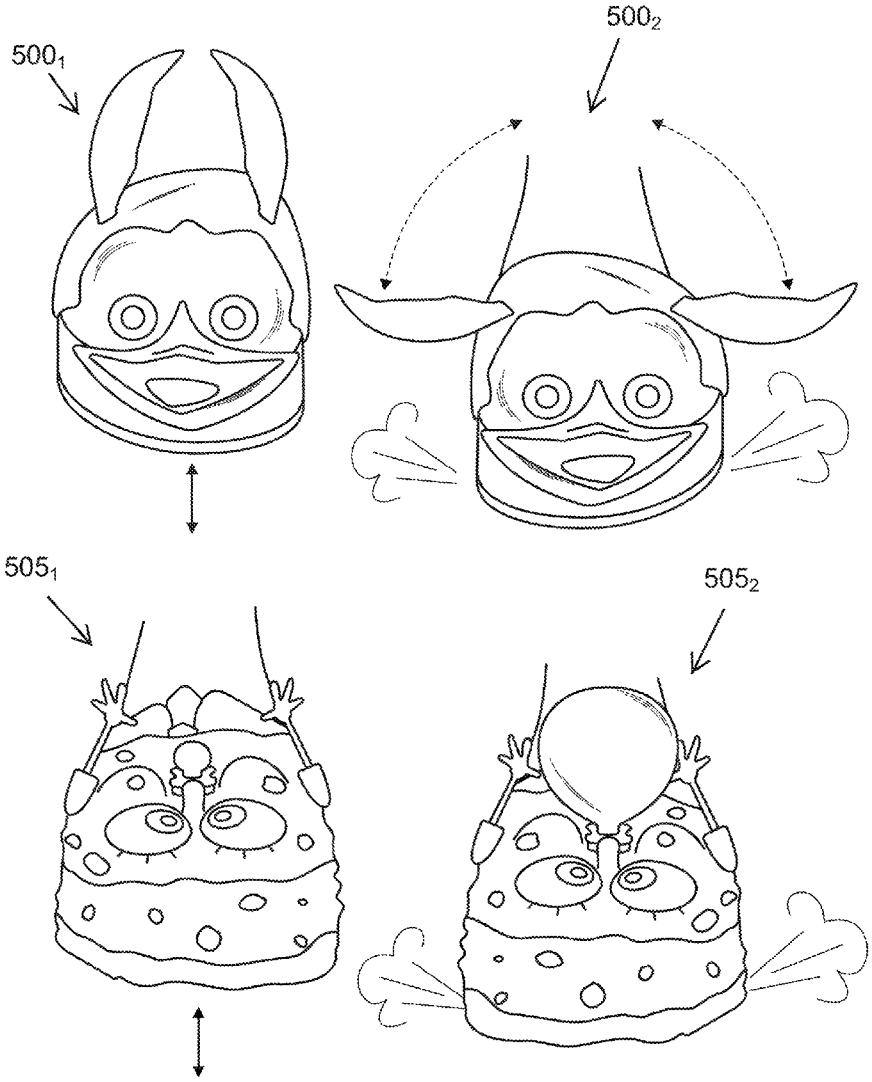

FIG. 4 illustrates front plan views of the fanciful air-powered active footwear articles shown in FIG. 1 and FIG. 3. First fanciful air-powered active footwear article 100 includes an unactuated mode $\mathbf{100}_1$ and an actuated mode $\mathbf{100}_2$ in response to a weighting or a step. Second fanciful air-powered active footwear article 300 includes an unactuated mode $\mathbf{300}_1$ and an actuated mode $\mathbf{300}_2$ in response to a weighting or a step. FIG. 5 illustrates front plan views of a pair of differently themed fanciful air-powered active footwear articles, including a third fanciful air-powered active footwear article 500 and a fourth fanciful air-powered active footwear article 505. Third fanciful air-powered active footwear article 500 includes an unactuated mode $\mathbf{500}_1$ and an actuated mode $\mathbf{500}_2$ in response to a weighting or a step. Fourth fanciful air-powered active footwear article 505 includes an unactuated mode $\mathbf{505}_1$ and an actuated mode $\mathbf{505}_2$ in response to a weighting or a step. Footwear article 500 includes a penguin/bird theme having a theme actuation that includes wings that flap down when actuated. (Note this is in contrast to other theme actuations in which the theme actuation raises a component when actuated.) Footwear article 505 may also include well-known themes, for example SpongeBob SquarePants® with an actuation theme that may include, for example, a bubble that is enlarged in actuation mode $\mathbf{505}_2$ and that is deflated in unactuated mode $\mathbf{505}_1$.

Figure 6:
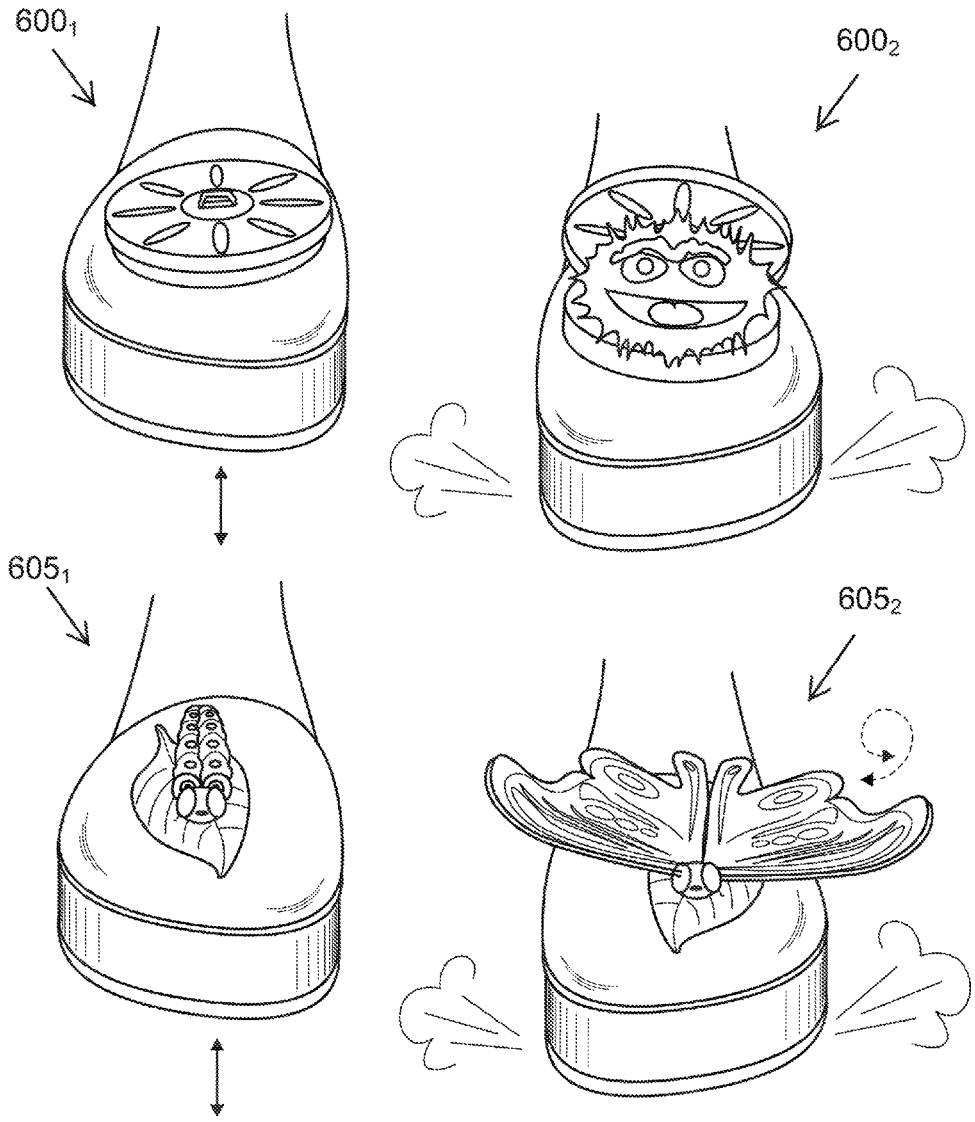

FIG. 6 illustrates front plan views of a pair of differently themed fanciful air-powered active footwear articles, including a fifth fanciful air-powered active footwear article 600 and a sixth fanciful air-powered active footwear article 605. Fifth fanciful air-powered active footwear article 600 includes an unactuated mode $\mathbf{600}_1$ and an actuated mode $\mathbf{600}_2$ in response to a weighting or a step. Sixth fanciful air-powered active footwear article 605 includes an unactuated mode $\mathbf{605}_1$ and an actuated mode $\mathbf{605}_2$ in response to a weighting or a step. Footwear article 600 may include a Muppet Oscar trashcan theme having a theme actuation that includes a lid of the trashcan flipping up and open to reveal Oscar inside. Footwear article 605 may include a metamorphosis theme having a theme actuation that includes a caterpillar on a leaf in which the caterpillar transforms (e.g., by "unrolling") to form a beautiful butterfly.

Figure 7:
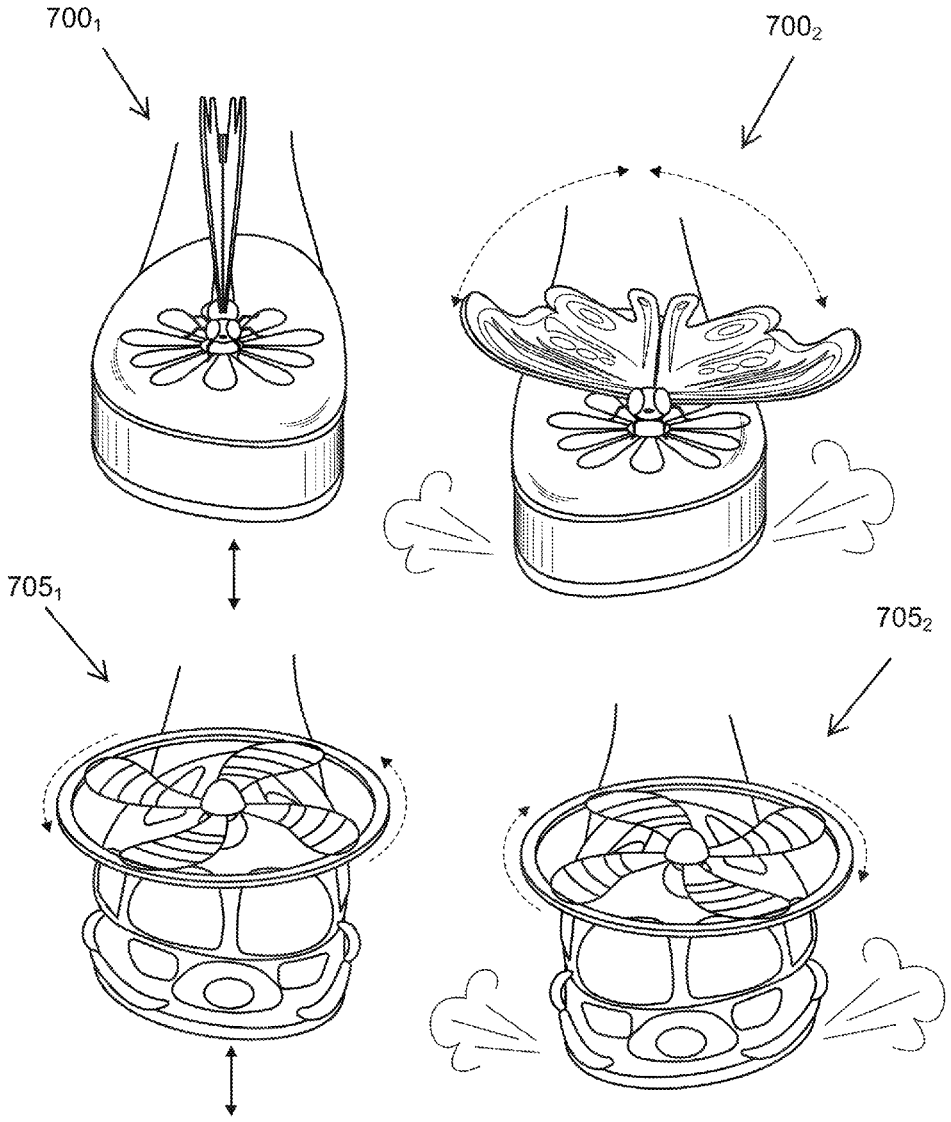

FIG. 7 illustrates front plan views of a pair of differently themed fanciful air-powered active footwear articles, including a seventh fanciful air-powered active footwear article 700 and an eighth fanciful air-powered active footwear article 705. Seventh fanciful air-powered active footwear article 700 includes an unactuated mode $\mathbf{700}_1$ and an actuated mode $\mathbf{700}_2$ in response to a weighting or a step. Eighth fanciful air-powered active footwear article 705 includes an unactuated mode $\mathbf{705}_1$ and an actuated mode $\mathbf{705}_2$ in response to a weighting or a step. Footwear article 700 may include a butterfly theme having a theme actuation that includes wings of the butterfly flapping (e.g., downward). Footwear article 705 may include a helicopter theme having a theme actuation that includes a main rotor of the helicopter rotating in response to the actuation. (In some embodiments it may be desirable to spin the main rotor in one direction upon an actuation and spinning the main rotor in the other direction upon a deactuation (while in other embodiments, the main rotor may not be spun in a counter-direction during the deactuation step, or the main rotor may be spun in the same direction during deactuation).

Figure 8:
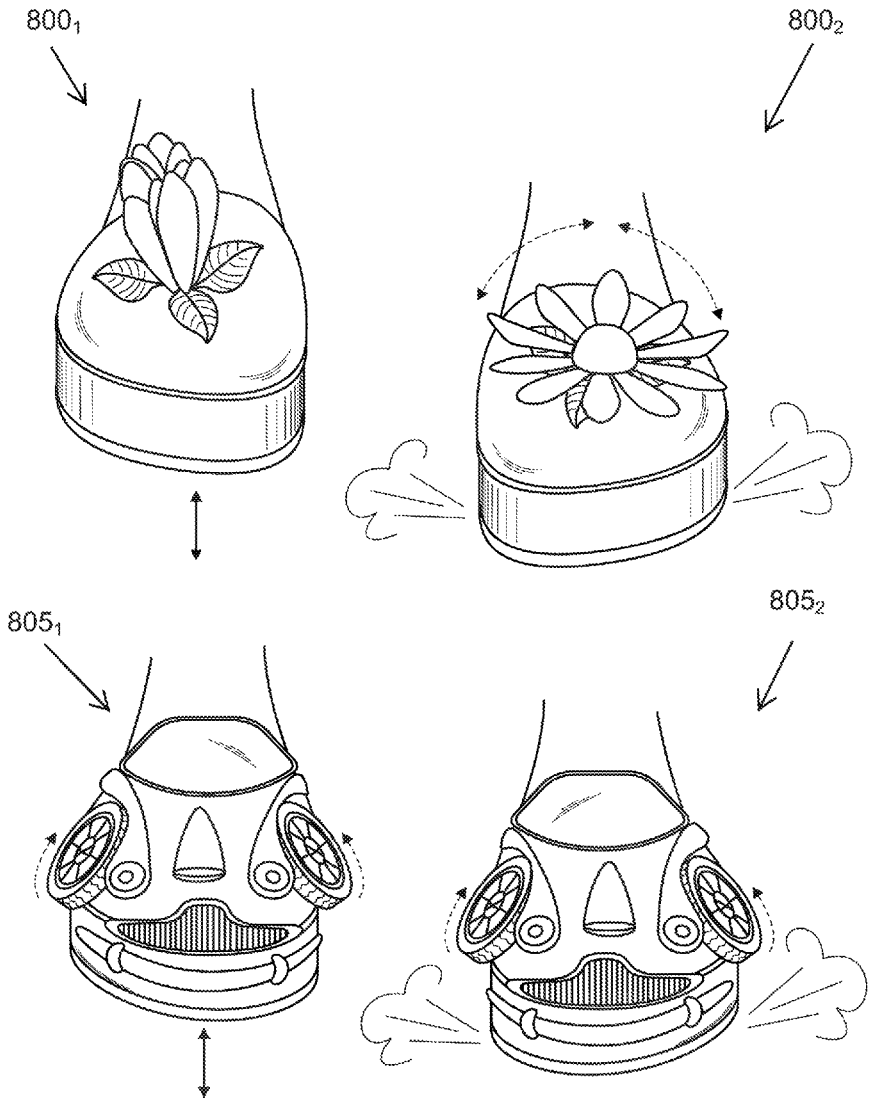

FIG. 8 illustrates front plan views of a pair of differently themed fanciful air-powered active footwear articles, including a ninth fanciful air-powered active footwear article 800 and a tenth fanciful air-powered active footwear article 805. Ninth fanciful air-powered active footwear article 800 includes an unactuated mode $\mathbf{800}_1$ and an actuated mode $\mathbf{800}_2$ in response to a weighting or a step. Tenth fanciful air-powered active footwear article 805 includes an unactuated mode $\mathbf{805}_1$ and an actuated mode $\mathbf{805}_2$ in response to a weighting or a step. Footwear article 800 may include a blooming flower theme having a theme actuation that includes movement of petals of a flower, such as a closed flower having its petals open upon actuation. Footwear article 805 may include a vehicle theme (e.g., a fire truck) having a theme actuation that includes rotation of wheels of the fire truck in response to actuation (for example, each actuation and de-actuation could rotate the wheels the same way).

Figure 9:
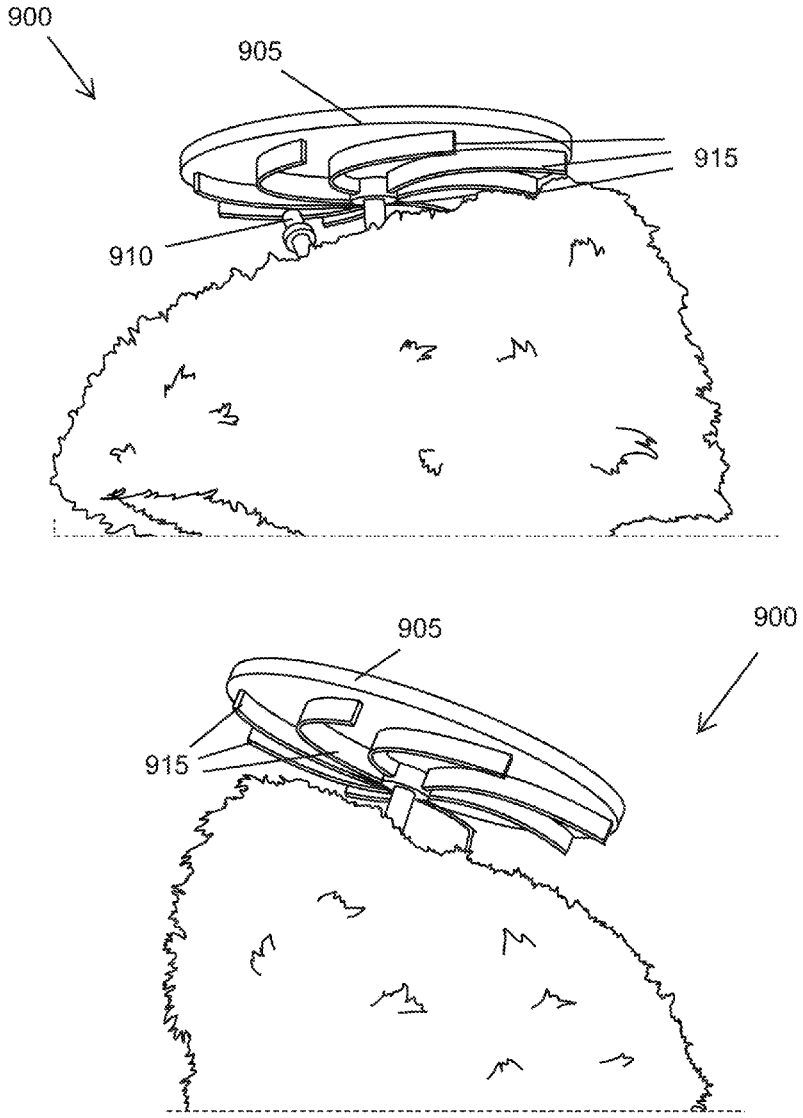

As noted, some embodiments include one or more spinning elements actuated by expelled air from the air cavity. FIG. 9 illustrates a left hand and a right hand view of a representative rotating air-powered actuator for use with a themed fanciful air-powered active footwear article described herein. Spinning/rotating elements may be actuated in several different ways, including directing an expelling air stream towards one or more arcuate vanes coupled to the element to be rotated. For example, in an air-powered rotating actuation assembly 900 having a rotating element 905, the quantity of air is expelled from a nozzle 910 and strikes one or more arcuate vanes 915 disposed on a surface receiving the expelled quantity of air. The expelled air striking the vanes causes the rotating element to rotate.

Figure 10:
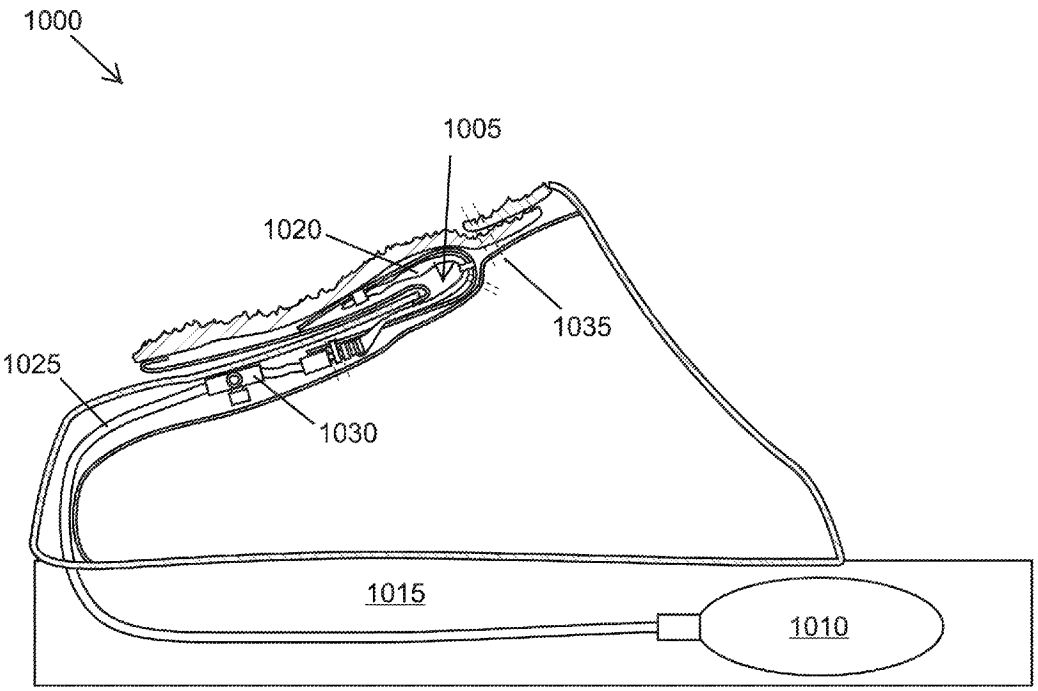
FIG. 10-FIG. 17 are additional illustrations of structural and operational details of preferred embodiments of the present invention.

FIG. 10-FIG. 17 are additional illustrations of structural and operational details of preferred embodiments of the present invention. FIG. 10 illustrates a cross-section of a representative footwear article 1000 including a representative installation of an air-actuated amusement system 1005.

Air-actuated amusement system 1005, further details of air-actuated amusement systems 1005 are shown in FIG. 11-FIG. 17, includes an air bladder 1010 disposed in a portion of, or throughout, a sole 1015 of footwear article 1000. An active element, an air-powered actuator 1020, responds to an air stream, air pressure, and the like (collectively herein air effect) and is affixed to, or incorporated into, a top portion of footwear article 1000. A non-kinking air hose 1025 couples the air bladder to the motion element to define an air channel between air bladder 1010 and the active element for directing the air effect. When a wearer places footwear article 1000 on a foot and steps down, the foot compresses air bladder 1010 against a walking surface to create the air effect. The air channel communicates this air effect to the active element for actuation.

Air bladder 1010 is a fluid (e.g., air) reservoir that contains a desired volume of air for the formation of the desired air effect qualities in response to the stepping of the wearer. It is sufficiently rugged to be stepped on and to have many cycles of contracting and expanding without bursting.

In the preferred embodiment, in some implementations there is a calibrated air volume within each air bladder 1010. This air volume is designed to generally match the air volume needed for the proper and complete actuation of the active element. For some active elements, it is possible that there can be inelastic deformation and expansion in response to too great a quantity of air. Over time, such active elements would need more air than is supplied from the air bladder in order to completely actuate. Thus an uncalibrated air quantity vis-à-vis the active element could, over time, degrade the user experience. In some cases, a significant mismatch between an air volume within the air bladder and a capacity of the active element could result in a bursting of the active element, particularly if a wearer expels the air stream vigorously. In other embodiments however, actuator 1020 may be include an expandable actuating structure which can be designed to readily accommodate air volume/pressure differentials.

Figure 31:
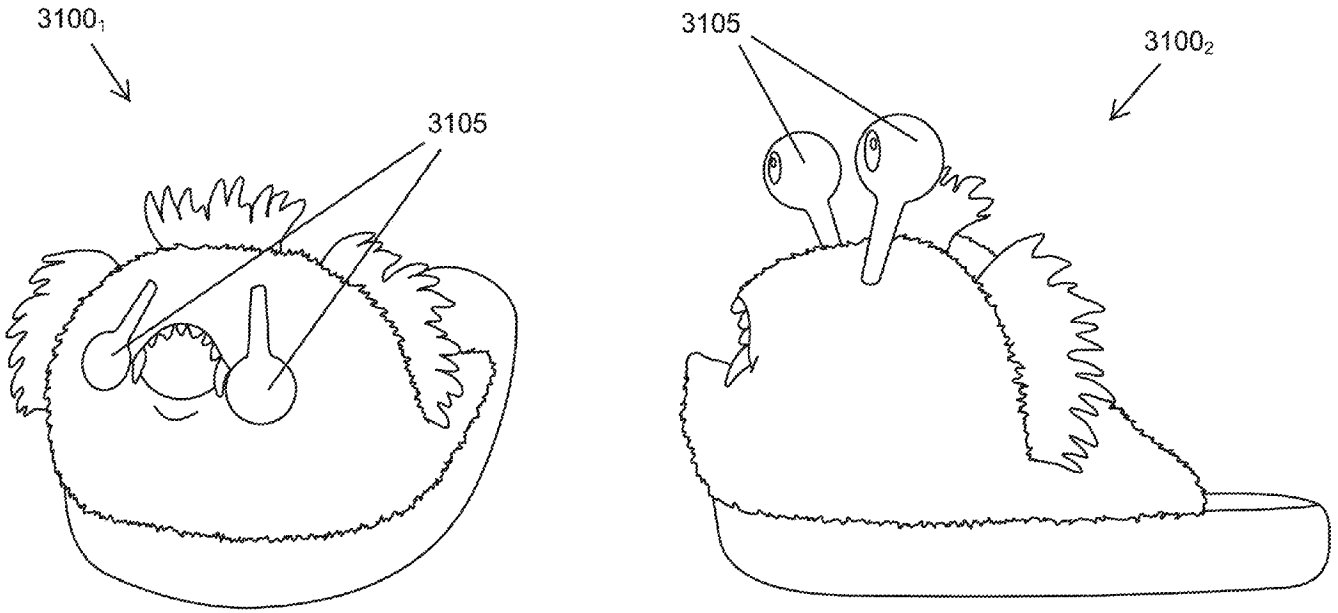
FIG. 31 illustrates a front perspective view and a side plan view of a first alien-themed fanciful air-powered active footwear article in, respectively, a relaxed mode and a stretching actuated mode.
Figure 32:
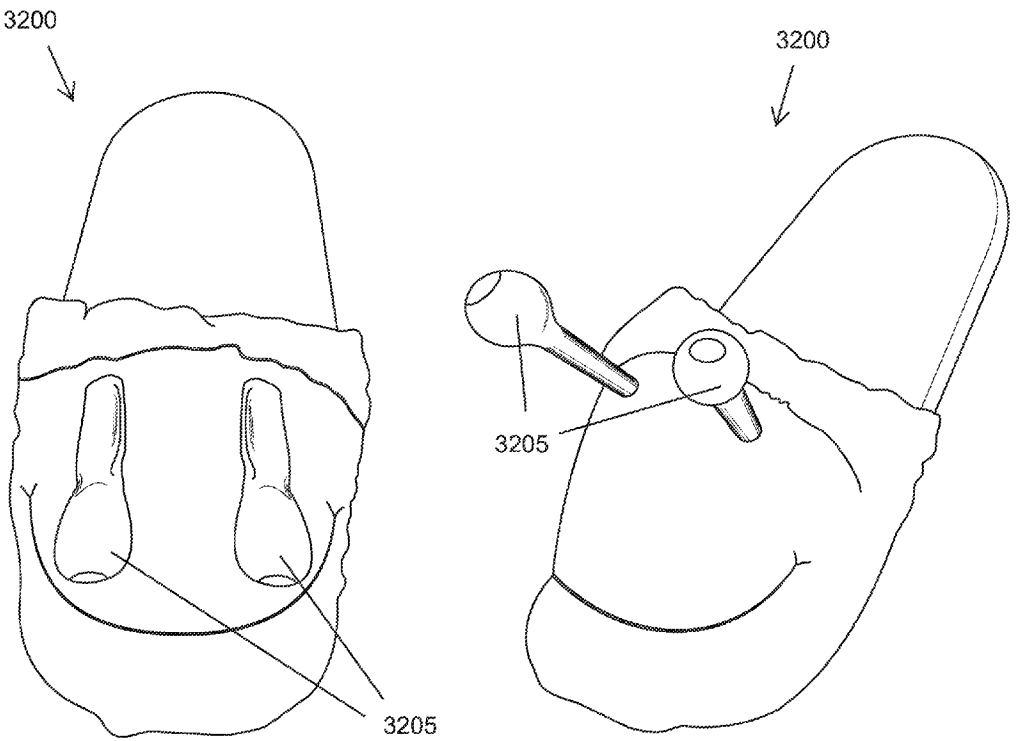
FIG. 32 illustrates a front perspective view and a side plan view of a second alien-themed fanciful air-powered active footwear article in, respectively, a relaxed mode and a non-stretching actuated mode.

FIG. 31 illustrates an alien-themed active footwear article 3100 including a non-expanding active element in the form of a pair of alien eyes 3105. In the non-expanding embodiment, alien eyes 3105 are coupled to air bladder 1010 of FIG. 10, a quantity of air from air bladder 1010 is calibrated to provide just the proper matching quantity of air needed to just actuate (e.g., fill) a deflated bladder (depicted as the externally visualized 'eyeballs'). This means that alien eyes 3105 raise and stand up while not critically overfilling/inelastically stretching the active element, which could result in deformation and improper operation in subsequent actuations. The left-hand image illustrates footwear article $\mathbf{3100}_1$ in the de-actuated state with the active elements unactuated and the right-hand image illustrates footwear article $\mathbf{3100}_2$ in the actuated state with the active elements "just filled" in which no appreciable expansion has occurred. FIG. 32 illustrates a second alien-themed active footwear article 3200 including an implementation of the non-expanding active element of FIG. 31 implemented as a child's slipper. Footwear article 3200 includes a different implementation of a pair of non-expanding alien eyes 3205. Alien eyes 3105 and alien eyes 3205 are different functional active elements from the google eye alien implementations shown in FIG. 16.

FIG. 10, for example, illustrates a refill mechanism 1030, e.g., a one-way valve or the like, disposed within the air channel. For example, the one-way valve is shown in air hose 1025 but could be implemented in air bladder 1010 or the active element, among other locations. Refill mechanism 1030 permits air bladder 1010 to expand and fill its volume with air when the wearer lifts the foot from the ground. Preferably refill mechanism 1030 offers zero to little resistance to air flow into air bladder 1010 and may be implemented in extremely simple ways (e.g., a collapsed tube or the like which inhibits air flow in one direction while offering little resistance to air flow in the opposite direction). Thereafter air bladder 1010 is ready to produce another stream of air to the active element upon another step by the wearer. When implemented as a one-way valve, refill mechanism 1030 permits air flow into air bladder 1010 through the air channel when the foot is lifted and inhibits air from escaping from the air channel when the foot is placed on the ground.

The active element has a great variety of potential implementation styles and options, a small sampling of which are shown and described herein. The active element may include one or multiple actuable components that respond with motion, sound, smell, visual, or other sensory stimulus or the like. In the preferred embodiment the active element is implemented for repeatable response(s) to the air effect initiated by the air effect in the air channel. The underlying structure(s) itself (themselves) may be implemented in many different ways, typically using the air effect as a hydraulic driver or to provide other mechanic force. Of course the air effect may be used as a switch input to a switch-controlled electromotive actuator or the like in the event that energy storage devices (e.g., a battery) and electromechanical features are implemented as part of the active element.

In some cases, the active element is directly experienced (e.g., when the active element itself is implemented as coiled tongue that unrolls in response to the air stream and re-rolls when the air bladder is refilled). In other cases, the active element is a part of the foundation and a façade or other interface masks the structure and operation of the active device (e.g., the tongue has a fanciful exterior covering to provide a desired look to the tongue with an interior mechanism that responds to the air effect). By operationally coupling the exterior covering to the interior mechanism, as the interior mechanism responds to the air effect, the exterior covering does so as well. For many active elements, there is essentially two modes: an unactuated state and an actuated state.

Depending upon many factors including the type of active element and how quickly responsive the active element is to be to the stepping down and lifting up of the foot, it may be necessary or desirable to implement a biasing mechanism for the active element to help return the active element from the actuated stated to the unactuated state. The biasing mechanism may be a supplemental structure added to the active element or the biasing mechanism may be integrated directly into the design of the active element. FIG. 10 includes attachment of the active element using a stitching 1035 designed to bias the system in the closed (e.g., unactuated) mode, and optionally as described herein, a memory plastic support.

A reason for the biasing mechanism is to help purge the air from the air channel to permit the active element to transition to the unactuated mode. In some instances, the active element includes a balloon, bladder, bag or other reservoir defining an air cavity and inflow of air from the bladder enlarges, expands, increases, or otherwise fills to effectuate the desired result. That is the actuated mode. To transition back to the unactuated mode, that reservoir in the active element must be emptied. The more quickly that the reservoir is emptied and the active element is transitioned to the unactuated mode, the quicker that the active element is able to be re-actuated.

The biasing mechanism can be gravity working against the actuated active element. For example, in some implementations, the actuated mode includes having a simulated "ear" stand up. The gravitational force that causes the ear to fall back down will deflate the reservoir or otherwise work to counter the actuating force from the air bladder. Other biasing mechanisms include memory materials that are structured to "remember" the unactuated mode. The air effect exerts enough control to counter the unactuated memory-maintaining force of the memory material to actuate the active element. Once the air effect force is reduced, the memory material restores the active element to the unactuated mode. Other springs, elastomeric elements, and resilient structures and materials may be strategically used to provide an appropriate biasing mechanism (and/or boost any inherent biasing mechanism) to improve the transition from the actuated mode to the unactuated mode.

Figure 11:
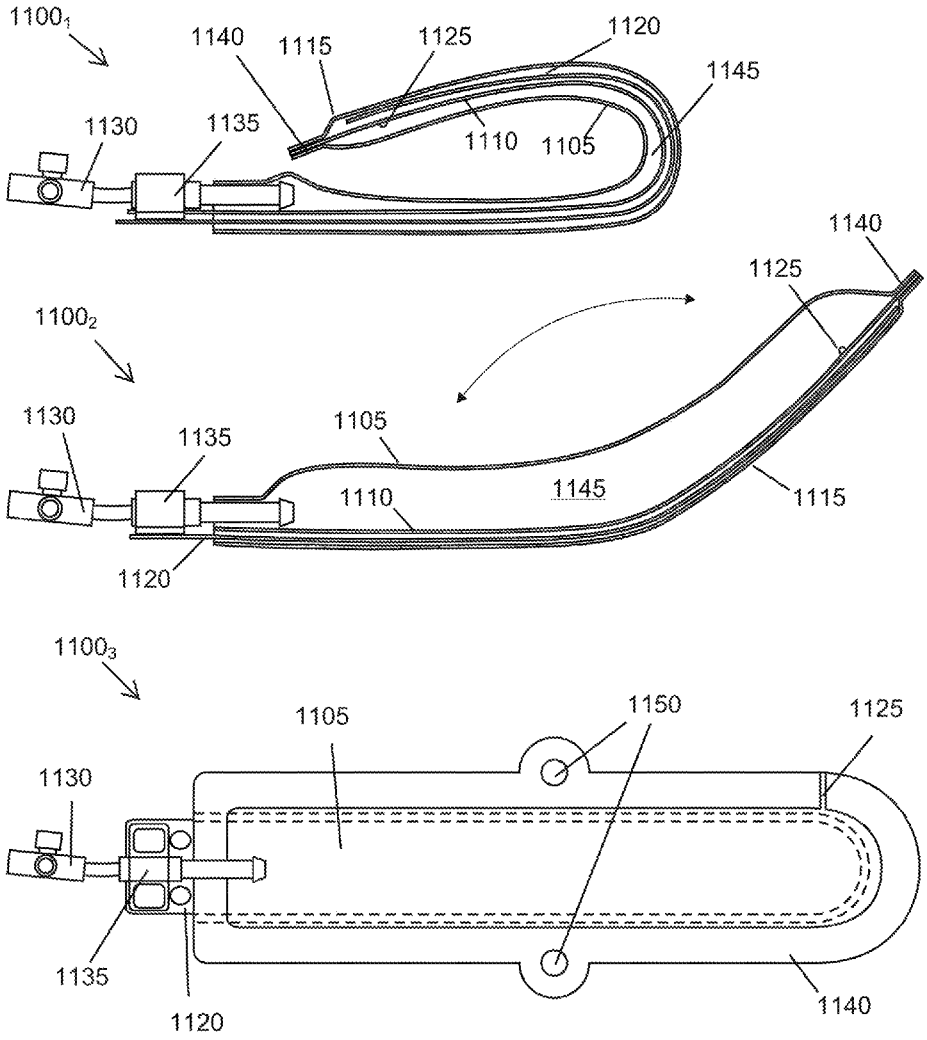

FIG. 11 is an illustration of details of an air-actuated amusement system 1100 such as could be used in footwear article 1000 shown in FIG. 10. Air-actuated amusement system 1100 includes a glued/heat sealed three layer polyester film (e.g., Mylar and the like) (first film layer 1105, second film layer 1110, and third film layer 1115) implementation forming a sleeve for a memory plastic return spring 1120. Additionally shown in FIG. 11 is use of an air bleed vent 1125 in addition to (though in some embodiments it can be in lieu of) a refill mechanism 1130 such as refill mechanism 1030. In some embodiments, air bleed vent 1125 may be present (intentionally or because of manufacturing specifications that allow less than perfect seals for the active elements) to provide some additional functionality, including helping to guard against bursting inflations and inelastic hyperextending inflations that deform the active element and can compromise subsequent cycles. For example, the air bladder transfers a specific amount of air on each step and that air passes through a one-way valve on its way to the actuator and the actuator includes an air release vent that starts to "bleed" the air slowly while the air bladder is depressed and then the air is quickly expelled out the one way valve when the air bladder is released (to quickly reset the actuator so it is ready for the next cycle of air).

The film layers are sealed around a periphery 1140 and form an air cavity 1145 between first film layer 1105 and second film layer 1110 and form the sleeve between second film layer 1110 and third film layer 1115. Connector 1135 is sealed into air cavity 1145 and is coupled to memory plastic return spring 1120 which communicates refill mechanism 1030 to air cavity 1145. In some implementations, simple film layers may become "sticky" due to environmental conditions (e.g., heat, humidity and the like) or other factor which can interfere with operation and in some cases increase a risk of operation-induced leaks and/or tears. One solution is to provide a "frost" or texture to the film layers where they contact another film layer.

Air-actuated amusement system 1100 is shown in three modes: a side view in a deflated closed mode $\mathbf{1100}_1$, a side view in a partially inflated/open mode $\mathbf{1100}_2$, and a top view of a fully inflated/open mode $\mathbf{1100}_3$. Air-actuated amusement system 1100 further illustrates a pair of mounting holes 1150 used for connecting to a hinge area of the footwear article.

Figure 12:
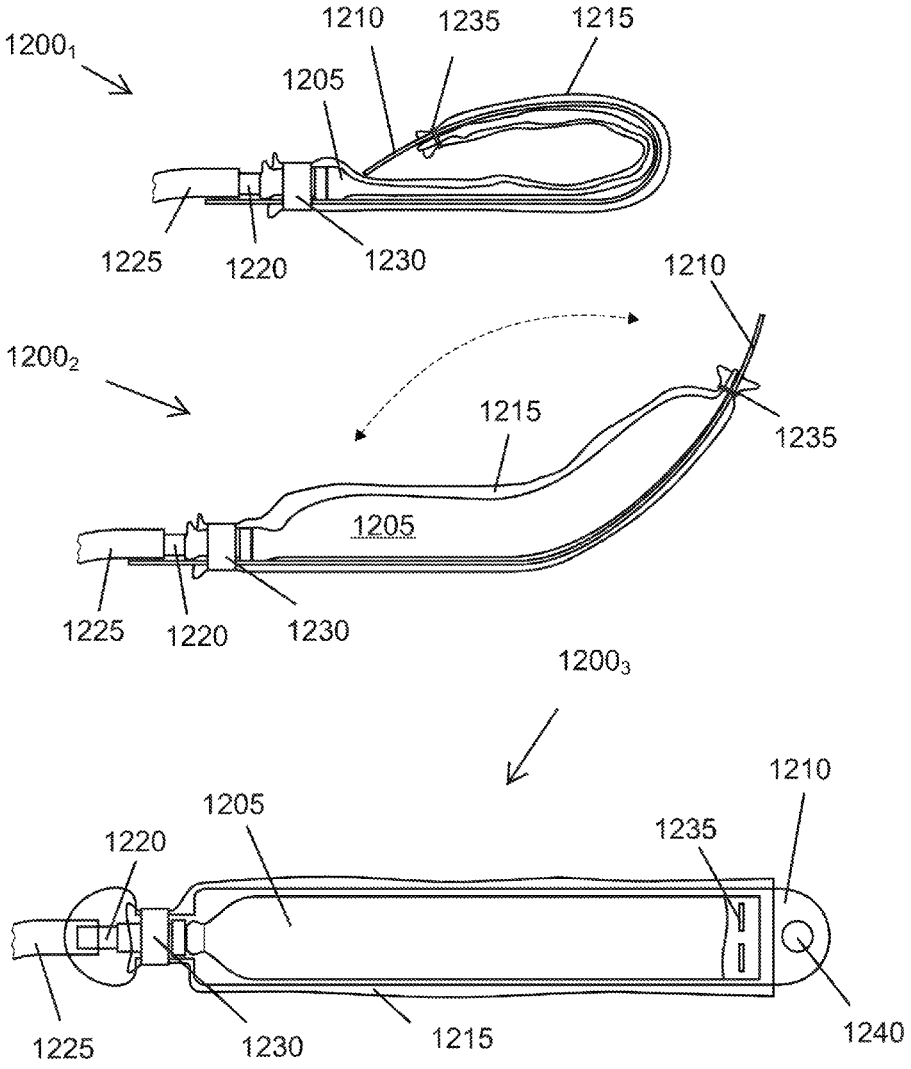

FIG. 12 is an illustration of details of an air-actuated amusement system 1200 such as could be used in footwear article 1000 shown in FIG. 10. Air-actuated amusement system 1200 includes an inflation balloon 1205 coupled to a memory plastic return spring 1210, both encased in an external sleeve 1215. return spring 1210 is bent to act as a living hinge for spring back closing action. A connector 1220 communicates an air hose 1225 into inflation balloon 1205. An attachment band 1230 (e.g., a rubber band or the like) helps to secure, and seal, a base of sleeve 1215/inflation balloon to connector 1220 and to one end of return spring 1210. An attachment staple 1235 secures an opposite end of sleeve 1215 to an opposite end of return spring 1210.

Air-actuated amusement system 1200 is shown in three modes: a side view in a deflated closed mode $\mathbf{1200}_1$, a side view in a partially inflated/open mode $\mathbf{1200}_2$, and a top view of a fully inflated/open mode $\mathbf{1200}_3$. Air-actuated amusement system 1200 further illustrates a mounting hole 1240 used for connecting to a hinge area.

Air effect operating on inflation balloon 1205 transitions air-actuated amusement system 1200 from deflated closed mode $\mathbf{1200}_1$ to partially inflated/open mode $\mathbf{1200}_2$. Inflation of inflation balloon 1205 operates against return spring 1210 and straightens it to produce fully inflated/open mode $\mathbf{1200}_3$, and thereby actuates a device on footwear article in response to a down step or a weighting. Up stepping or un-weighting results in deflation of inflation balloon 1205, and return spring 1210 helps to return the footwear article to deflated closed mode $\mathbf{1200}_1$.

Figure 13:
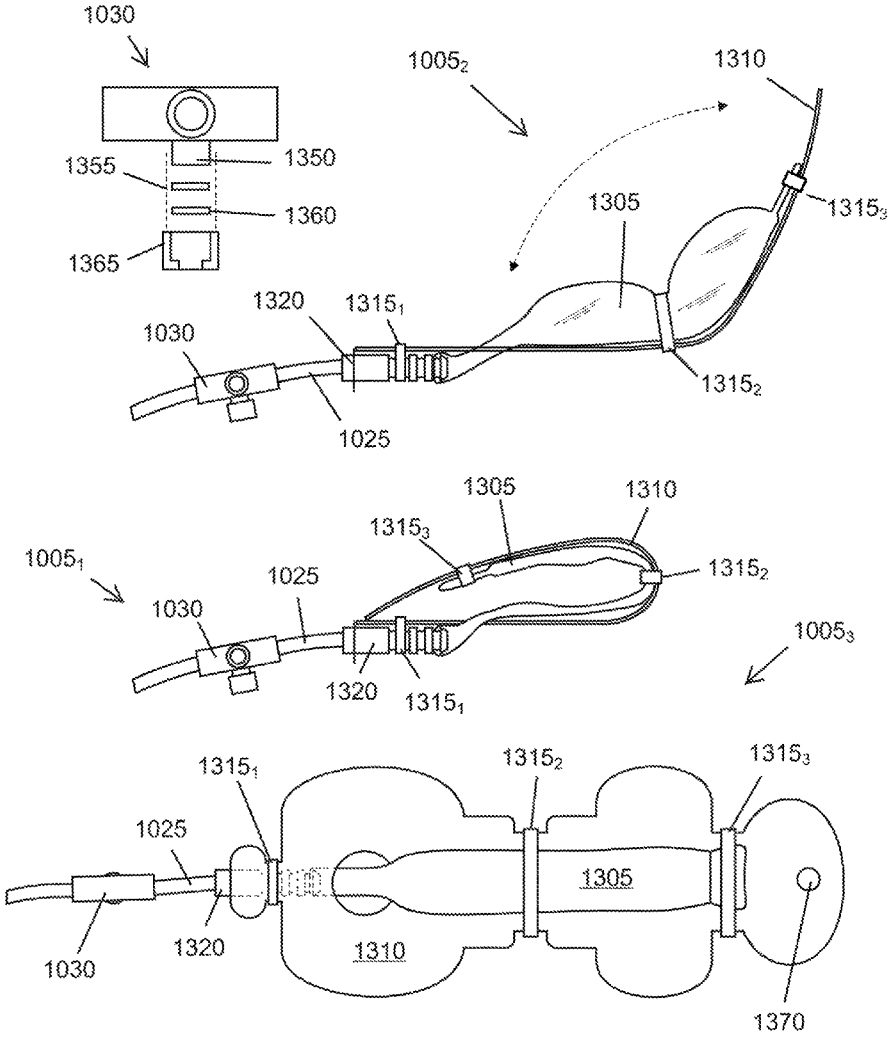
Figure 14:
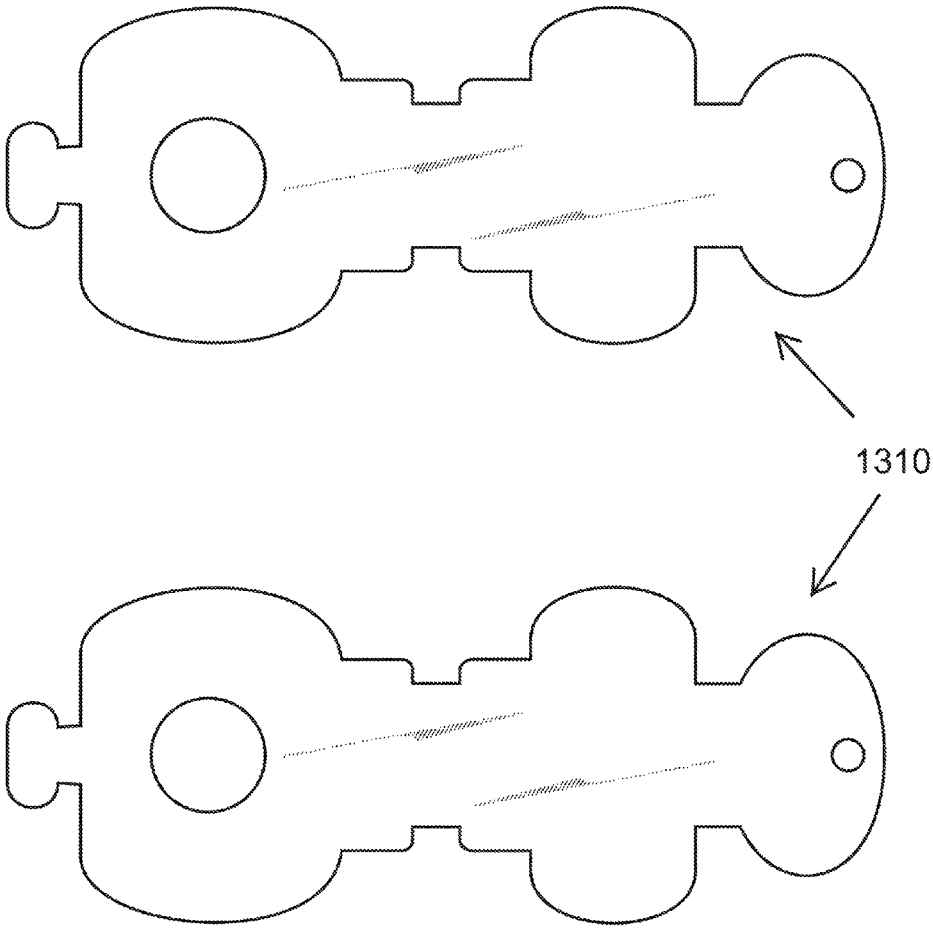

FIG. 13 is an illustration of details of air-actuated amusement system 1005 as used in footwear article 1000 shown in FIG. 10. Air-actuated amusement system 1005 includes a balloon 1305 with an external memory plastic return spring 1310 attached using three elastomeric bands 1315 (a first elastomeric band $\mathbf{1315}_1$, a second elastomeric band $\mathbf{1315}_2$ (optional), and a third elastomeric band $\mathbf{1315}_3$). FIG. 14 is an illustration of external memory plastic return spring 1310 shown in FIG. 13. External memory plastic return spring 1310 is bent to act as a living hinge for spring back closing action, with its "memory" set in the bent mode. A connector 1320 communicates an air hose 1025 from refill mechanism 1030 into balloon 1305. Elastomeric bands 1315 secure balloon 1305 and connector 1320 to external memory plastic return spring 1310. It is important that the middle elastomeric band (i.e., second elastomeric band $\mathbf{1310}_2$) is not too tight as it could inhibit/prevent proper inflation of balloon 1305. As noted, this second elastomeric band is optional and may be absent in specific implementations. In FIG. 13, actuator 1020 (shown in FIG. 10) is implemented by balloon 1305 secured to external memory plastic return spring 1310.

Also illustrated in FIG. 13 is an exploded view of components of refill mechanism 1030. Refill mechanism 1030 includes an aperture 1350, a fabric layer 1355, a rubber diaphragm 1360, and a cap 1365. Fabric layer 1355 permits one way air leakage/flow through refill mechanism 1030.

Air-actuated amusement system 1005 is shown in three modes: a side view in a deflated closed mode $\mathbf{1005}_1$, a side view in a partially inflated/open mode $\mathbf{1005}_2$, and a top view of a fully inflated/open mode $\mathbf{1005}_3$. Air-actuated amusement system 1005 further illustrates a mounting hole 1370 used for connecting to a hinge area of the footwear article 1000.

Air effect operating on balloon 1305 transitions deflated closed mode $\mathbf{1005}_1$ to partially inflated/open mode $\mathbf{1005}_2$ for air-actuated amusement system 1005, such as by air flowing into balloon 1305 and inflating it. Inflation of balloon 1305 operates against external memory plastic return spring 1310 and straightens it to produce fully inflated/open mode $\mathbf{1005}_3$, and thereby actuates a device (e.g., ear) on footwear article 1000 in response to a down step or a weighting. Up stepping or un-weighting results in deflation of balloon 1305 and external memory plastic return spring 1310, and external memory plastic return spring 1310 helps to return footwear article 1000 to deflated closed mode $\mathbf{1005}_1$.

Figure 15:
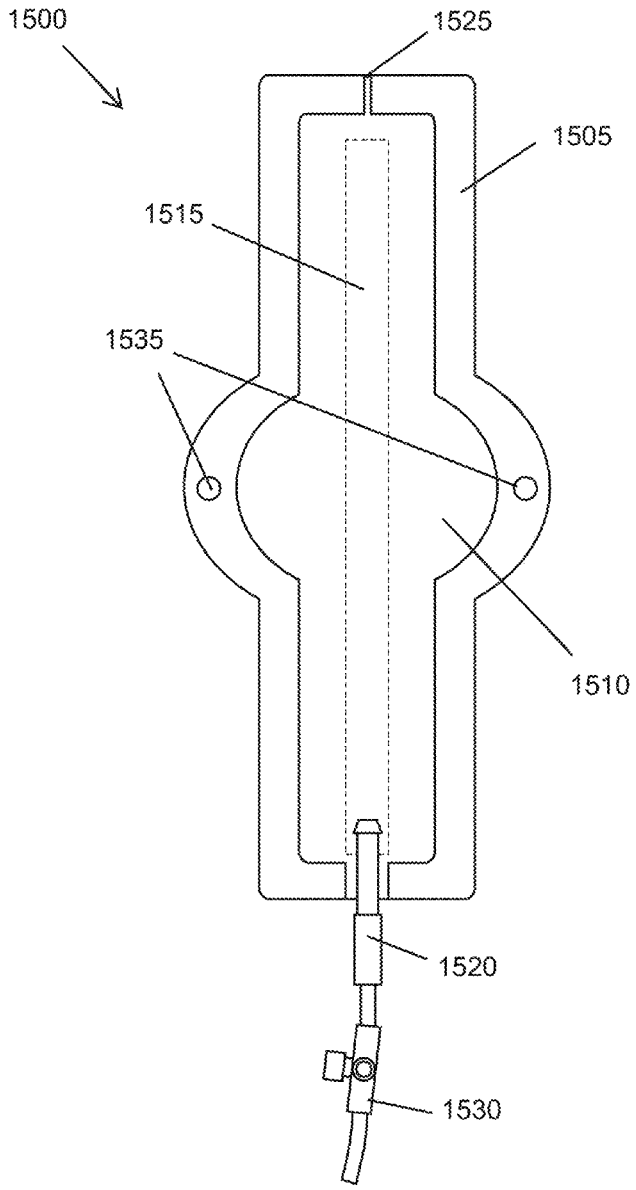

FIG. 15 illustrates an optional balloon mechanism 1500 such as may be used in actuators and air-actuated amusement systems as described herein. Optional balloon mechanism 1500 includes a pair of sealed (e.g., glued) flexible layers 1505 defining an air cavity 1510 therebetween. Layers 1505 may be any suitable flexible, non-porous, material (for expandable designs, an elastomeric polymer or the like may be used). An optional strip of fabric 1515 extends down an longitudinal axis from a connector 1520 to an air release vent 1525. Optional balloon mechanism 1500 further includes a one-way valve 1530 (see, for example, refill mechanism 1030 and refill mechanism 1130 described herein) and one or more mounting holes 1535.

Optional strip of fabric 1515 allows for an air channel to exist within air cavity 1510 for retreating air when air cavity 1510 is deflating. Air release vent 1525 is disposed at a far end of air cavity 1510 from an air inlet end defined by connector 1520. In this way, air release vent 1525 does not appreciably interfere with quick inflation of optional balloon mechanism, yet it helps to protect against over pressure rupture and helps resetting an actuated device to the unactuated mode in preparation for a quick re-actuation.

Figure 16:
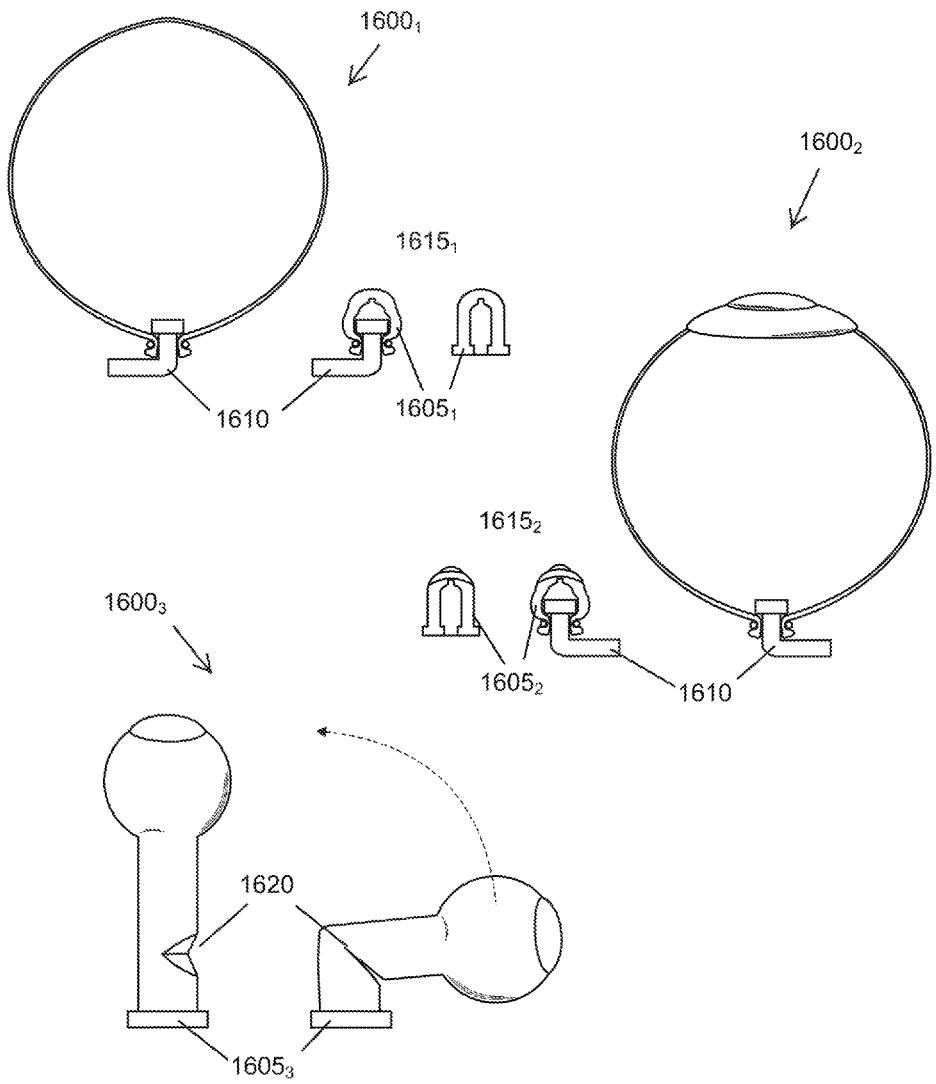

FIG. 16 illustrates a first set of thermoplastic rubber (TPR) implementations for an active element. TPR as used herein includes thermoplastic elastomers and copolymers and the like that have both thermoplastic and elastomeric properties. The set includes a first active element $\mathbf{1600}_1$ simulating a "bubble" (e.g., an expanding/contracting fish bubble), a second active element $\mathbf{1600}_2$ simulating an "eye ball" (e.g., an expanding/contracting eye ball balloon), and a third active element $\mathbf{1600}_3$ simulating a google eye alien (e.g., an inflating/deflating eye stalk).

First active element $1600_1$ includes a TPR balloon $1605_1$ that is mounted to an air port 1610. An internal dimple $1615_1$ disposed in TPR balloon $1605_1$ helps to ensure that TPR balloon $1605_1$ expands from the same spot every cycle. TPR balloon $1605_1$ is structured to ensure that the inflated mode offers the desired effect for a footwear article, i.e., an enlarged bubble.

Second active element $1600_2$ includes a TPR balloon $1605_2$ that is mounted to an air port 1610. An internal dimple $1615_2$ disposed in TPR balloon $1605_2$ helps to ensure that TPR balloon $1605_2$ expands from the same spot every cycle. TPR balloon $1605_2$ is structured to ensure that the inflated mode offers the desired effect for a footwear article, i.e., an enlarged eye ball. Dimple $1615_2$ is important for an enlarging structure that may look distorted when enlarged from an incorrect expansion point (e.g., an eye ball).

Third active element $1600_3$ includes a non-expanding TPR balloon $1605_3$. TPR balloon $1605_3$ is coupled to any connector communicated to the air bladder and may be adapted to move between different defined configurations when transitioning between an actuated mode (standing straight up for example) and an unactuated mode (laid over on one side for example). A hinge area 1620 helps to ensure that TPR balloon $1605_3$ exhibits the desired behavior when transitioning between modes.

Figure 17:
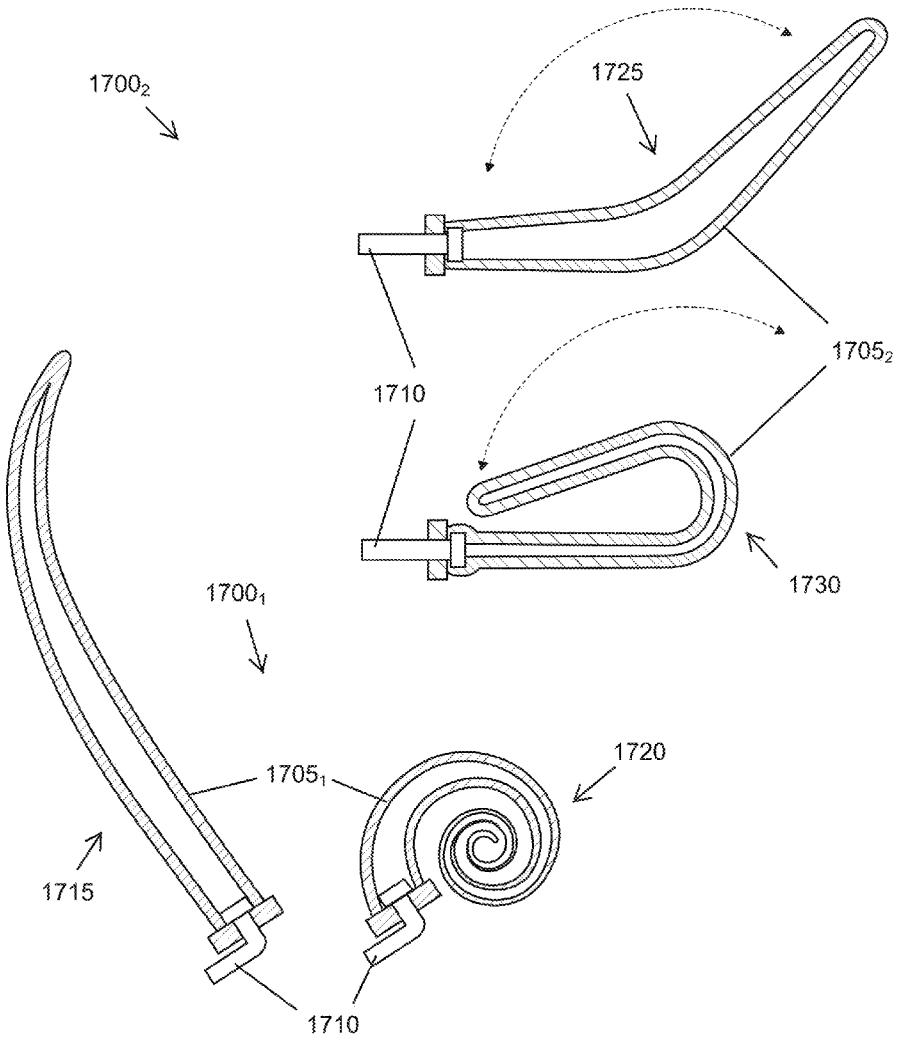

FIG. 17 illustrates a second set of thermoplastic rubber (TPR) implementations for an active element. The second set includes a first active element $1700_1$ simulating a rolling "tongue" (e.g., a furling/unfurling tongue), a second active element $1700_2$ simulating a flapping element (e.g., an expanding/contracting limb, appendage, growth, or door, hatch, portal, or the like). First active element $1700_1$ includes a TPR balloon $1705_1$ that is mounted to an air port 1710. TPR balloon $1705_1$ rolls out when inflated to provide an extended tongue 1715 and rolls up when deflated to provide a retracted tongue 1720. Second active element $1700_2$ includes a TPR balloon $1705_2$ that is mounted to an air port 1710. TPR balloon $1705_2$ opens when inflated to provide an extended structure 1725 and closes when deflated to provide a retracted structure 1730.

One advantage of TPR and other materials in this class is that they include better "memory" and may be stretched and expanded with reduced risk of compromising an integrity of the active element. In the case of active elements that include elastic, non-deforming expansions, the air bladder is calibrated to provide a different (e.g., increased) quantity of air as compared to an elastic deformable active element.

As described, first active element $1700_1$ and second active element $1700_2$ are shown and described as non-actuating elements that are visually modified for direct use in an amusement system. One advantage of these structures is that they include self-biasing features and no additional memory spring or the like is necessary to aid deflation when deactuating. Other embodiments may use variations of first active element $1700_1$ and second active element $1700_2$ as actuating active elements. Further, these elements may be constructed in many different ways. One variation for an inexpensive actuating active element includes a blow-molded bladder in which heat or the like is used to preform the bladder into a "memorized" configuration appropriate for an unactuated mode, similar in visualization to second active element $1700_2$. Air effect operating on this bladder straightens it to an actuated mode which will automatically transition to the unactuated mode when the actuating air effect is released.

Figure 38:
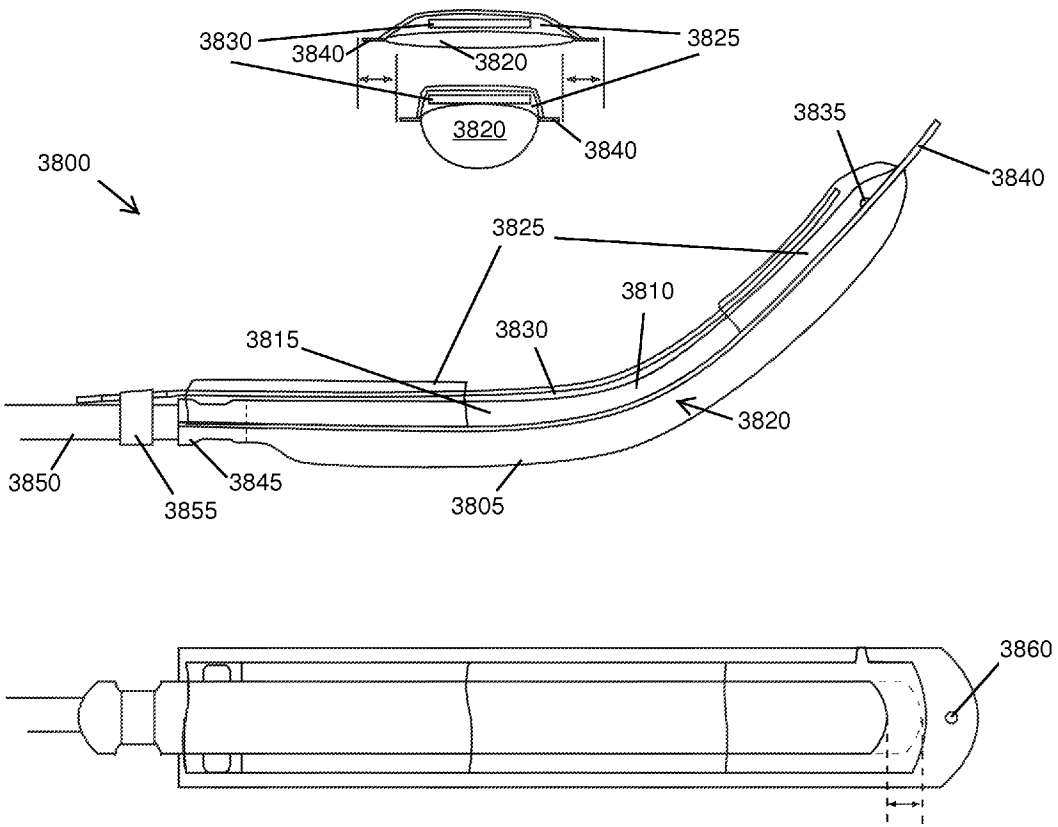
FIG. 38 illustrates a set of views of an operational sequence for a ninth type of air-powered actuator for use with a themed fanciful air-powered active footwear article described herein.

FIG. 38 illustrates a set of views for a ninth type of air-powered actuator 3800 for use with a themed fanciful air-powered active clothing article, such as the themed footwear articles described herein. Air-powered actuator 3800, a variation on air-actuated amusement system 1100) includes a glued/welded/heat-sealed three layer polyester film (e.g., Mylar and the like) (first film layer 3805, second film layer 3810, and third film layer 3815) implementation forming an air cavity 3820 (non-stretching) and a partial sleeve 3825 for a memory plastic return spring 3830. Additionally shown in FIG. 38 is use of an air bleed vent 3835 in addition to (though in some embodiments it can be in lieu of) a refill mechanism as described herein.

The film layers are sealed around a periphery 3840 and form an air cavity 3820 between first film layer 3805 and second film layer 3810 and form partial sleeve 3825 between second film layer 3810 and third film layer 3815. A connector 3845 is sealed into air cavity 3820 and is coupled to a conduit 3850 (e.g., non-kinking air hose and the like). Preferably connector 3845/conduit 3850 are registered to memory plastic return spring 3830, such as by coupling them together, for example attaching them using an elastomeric band 3855 or the like.

Air-actuated amusement system 3800 is shown in two modes: both a side view and a front view in a partially inflated/open mode $3800_1$, and a top view and a front view of a fully inflated/open mode $3800_2$. Fully inflated/open mode $3800_2$ further illustrates a mounting hole 3860 used for connecting to an actuable component of the object into which air-actuated amusement system 3800 is incorporated, e.g., the footwear article and the like.

Partial sleeve 3825 holds memory plastic return spring 3830. Partial sleeve 3825 is formed by providing a gap region in third film layer 3815 in the area where air-actuated amusement system 3800 is "hinged" (e.g., bends) which decreases repetition-induced failures.

In operation, air-actuated amusement system 3800 is constructed so that memory plastic return spring 3830 remembers a bent/folded configuration. Due to memory plastic return spring 3830 being disposed within partial sleeve 3825, air-actuated amusement system 3800 has a "natural" non-actuated closed disposition. In this non-actuated closed disposition, air cavity 3820 is almost completely collapsed. (Practically there will always be some air residual, and it should be noted that for some applications responsiveness is improved by not completely evacuating air cavity 3820.) A proximal end where connector 3845 is joined to memory plastic return spring 3830 is generally proximate to a distal end where mounting hole 3860 is provided. In the collapsed mode, a "width" of air-actuated amusement system 3800 is greatest because the layers are flat and overlay each other.

When actuated, air enters into air cavity 3820, causing it to non-stretchingly inflate. This results in an effective width of air-actuated amusement system 3800 decreasing as air cavity 3820 transforms from a pliant (e.g., a flat and bendable) structure to a generally rounded and rigid structure. The front views illustrate an example of this width change. Responsive to inflation/deflation of air cavity 3820 that opens/closes air-actuated amusement system 3800, it is also a consequence that a memory plastic return spring 3830 moves within partial sleeve 3825. This is illustrated in fully inflated/open mode $3800_2$ where a spacing between an end of memory plastic return spring 3830 and the distal end changes. In the specific configuration shown in FIG. 38, this spacing contracts as air-actuated amusement system 3800 closes. Thus, as the device opens and closes, partial sleeve 3825 moves relative to memory plastic return spring 3830. This relative motion can be problematic as it may interfere with proper operation (e.g., opening and closing) and it may increase risks of failure (e.g., introduction of an unintended tear or aperture in air cavity 3820) through stresses. Preferred embodiments provide sufficient lateral and end spacing of partial sleeve 3825 relative to memory plastic return spring 3830 to account for the relative dimensional changes noted herein.

Figure 18:
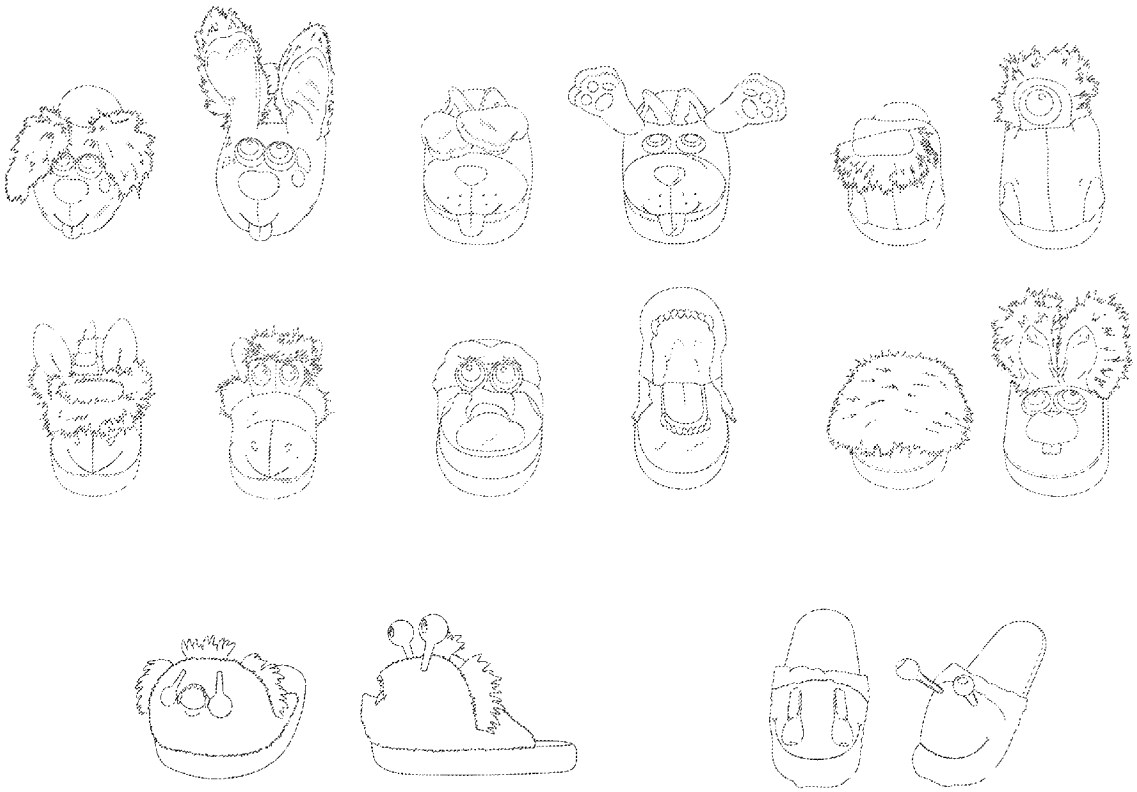
FIG. 18-FIG. 30 are additional illustrations of representative implementations of selected ones of the disclosed preferred embodiments.

FIG. 18-FIG. 30 are additional illustrations of representative implementations of selected ones of the disclosed preferred embodiments. FIG. 18 illustrates a set of industrial designs for a range of footwear articles having differing themes and theme actuations, along with corresponding differing active elements.

Figure 19:
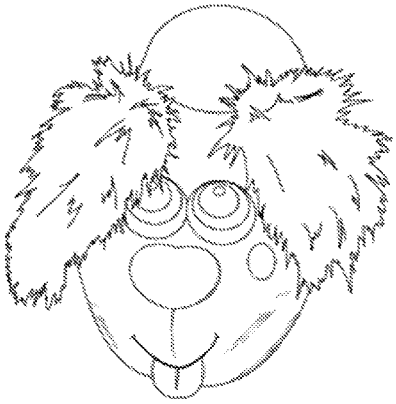
Figure 20:
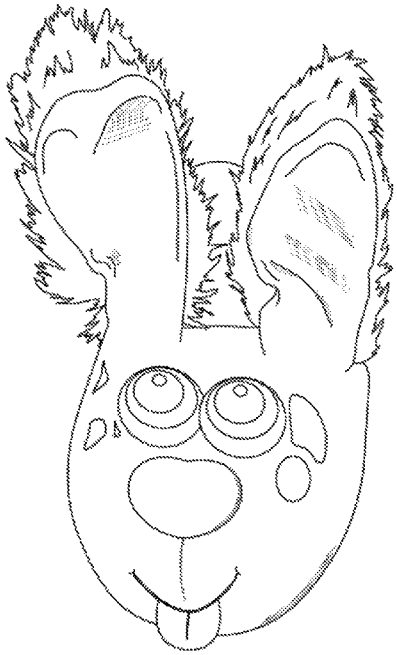

FIG. 19 is an illustration of an unactuated footwear article having active elements incorporated into simulated ears. FIG. 20 is an illustration of the footwear article of FIG. 19 in the actuated mode in which the simulated ears extend upwardly from a body of the footwear article.

Figure 21:
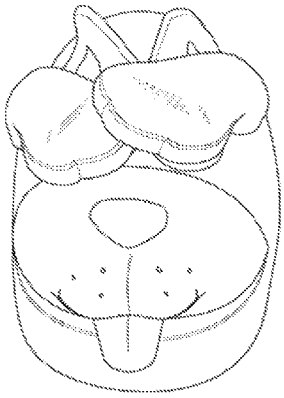
Figure 22:
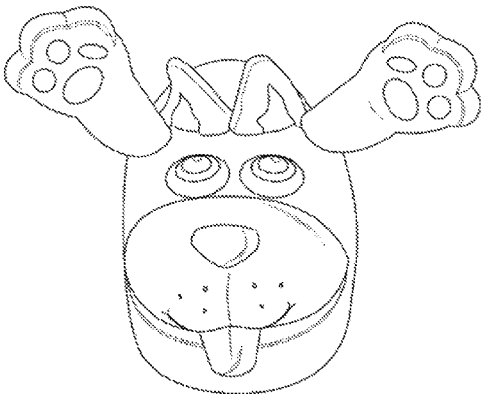

FIG. 21 is an illustration of an unactuated footwear article having active elements incorporated into simulated paws. FIG. 22 is an illustration of the footwear article of FIG. 21 in the actuated mode in which the simulated paws extend outwardly from a body of the footwear article.

Figure 23:
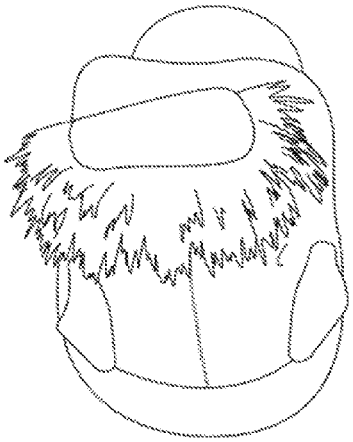
Figure 24:
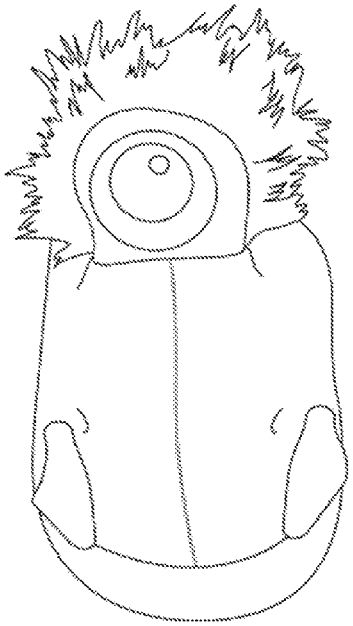

FIG. 23 is an illustration of an unactuated footwear article having active elements incorporated into a simulated eyelid. FIG. 24 is an illustration of the footwear article of FIG. 23 in the actuated mode in which the simulated eyelid opens from a body of the footwear article to reveal an eye.

Figure 25:
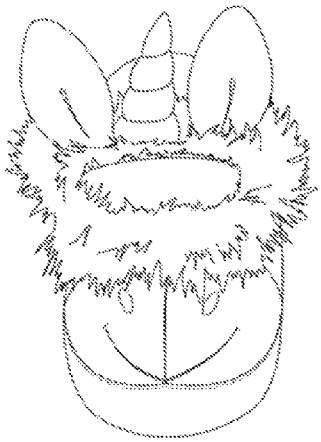
Figure 26:
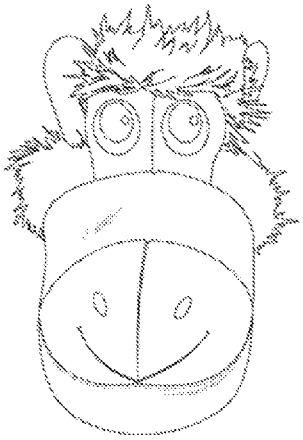

FIG. 25 is an illustration of an unactuated footwear article having active elements incorporated into a head. FIG. 26 is an illustration of the footwear article of FIG. 25 in the actuated mode in which the head opens upwardly from a body of the footwear article to reveal a set of eyes.

Figure 27:
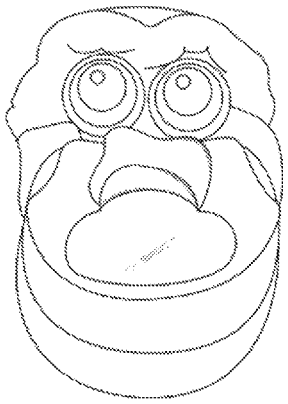
Figure 28:
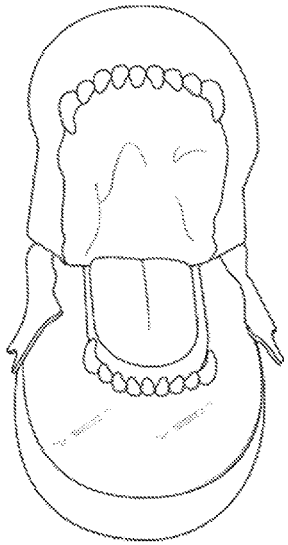

FIG. 27 is an illustration of an unactuated footwear article having active elements incorporated into a simulated mouth. FIG. 28 is an illustration of the footwear article of FIG. 27 in the actuated mode in which the simulated mouth opens upwardly from a body of the footwear article to reveal a tongue and other internal components of the mouth.

Figure 29:
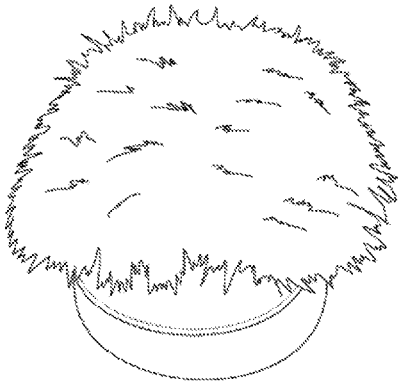
Figure 30:
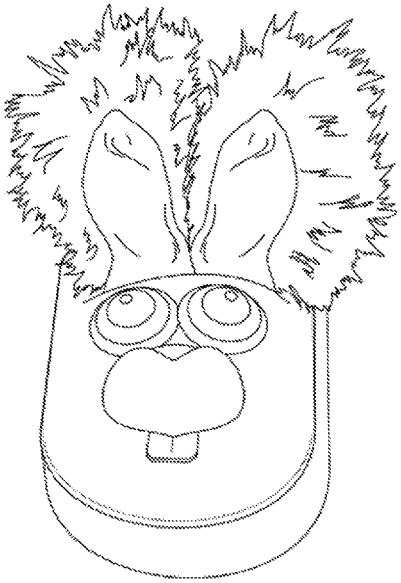

FIG. 29 is an illustration of an unactuated footwear article having active elements incorporated into a pair of simulated ears. FIG. 30 is an illustration of the footwear article of FIG. 29 in the actuated mode in which the ears extends upwardly from a body of the footwear article to reveal previously hidden facial features covered by the simulated ears in the unactuated mode.

Figure 33:
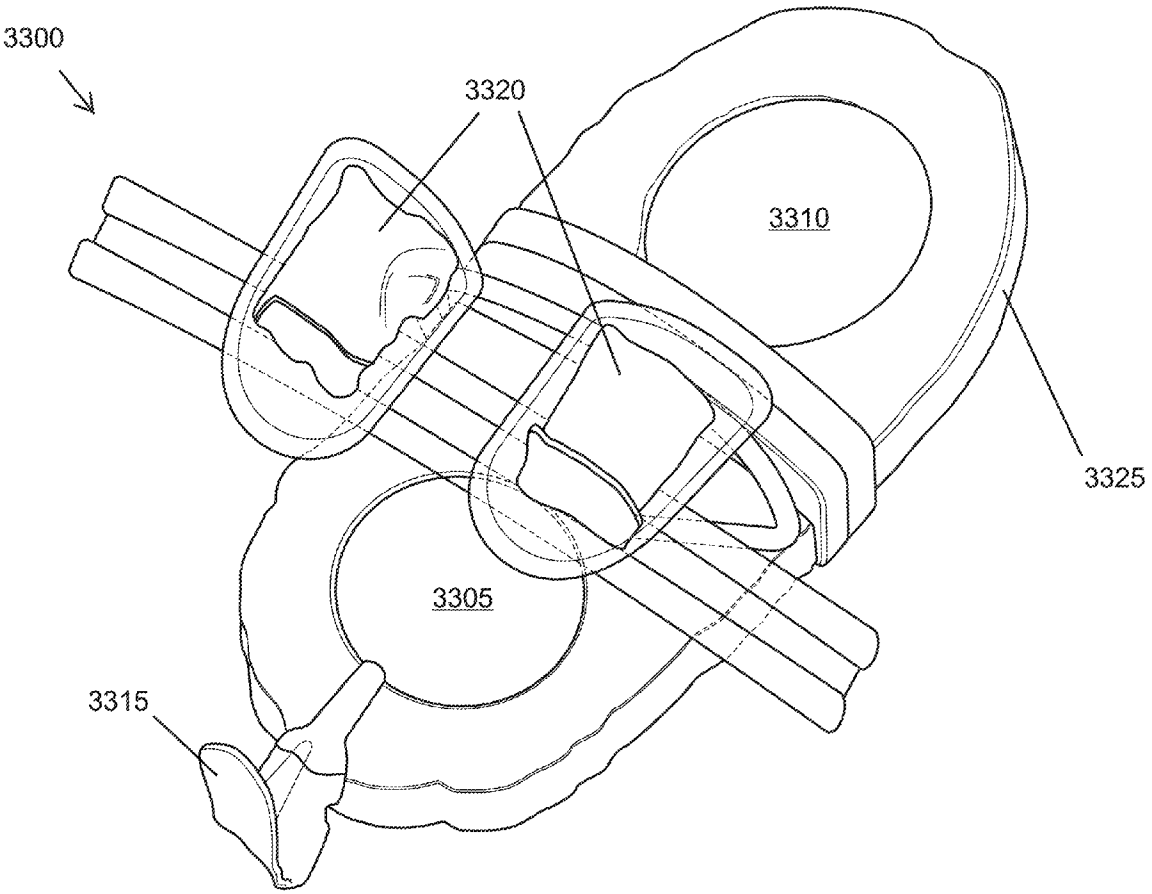
FIG. 33 illustrates a cutaway view of a representative independent multibladder embodiment for an air-powered active footwear article wherein the footwear article includes a front air bladder and a rear air bladder each independently operable from the other.
Figure 34:
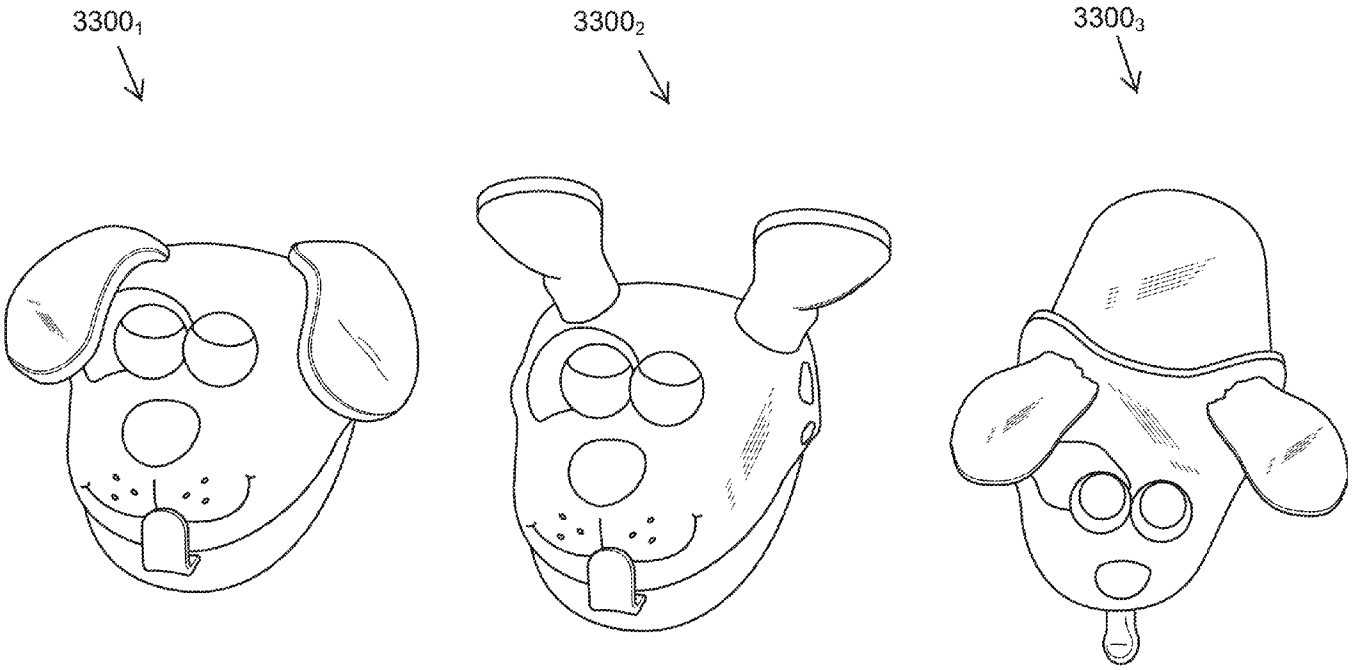
FIG. 34 illustrates a set of front perspective modes highlighting representative independent action of a pair of air-powered accessories coupled to the multibladder shown in FIG. 33 in three modes (from left to right): an unactuated mode (tongue retracted and ears down), ear actuated mode (tongue retracted and ears up), and a tongue actuated mode (tongue extended and ears down)

FIG. 33 and FIG. 34 illustrate a multibladder embodiment for a footwear article 3300. FIG. 33 illustrates that footwear article 3300 includes a front air bladder 3305 and an independently operable rear air bladder 3310. A "tongue" 3315 is actuated from front air bladder 3305 and a pair of ears 3320 are actuated from rear air bladder 3310. Front air bladder 3305 and rear air bladder 3310 are both disposed in a sole 3325. FIG. 34 illustrates the independent action of the active elements in three modes (from left to right): first mode footwear article $\mathbf{3300}_1$—an unactuated mode (tongue retracted and ears down), second mode footwear article $\mathbf{3300}_2$—ear actuated mode (tongue retracted and ears up), and third mode footwear article $\mathbf{3300}_3$—a tongue actuated mode (tongue extended and ears down). Because these are independent, it is also possible for a user to both extend the tongue and lift the ears by expelling air from both front air bladder 3305 and rear air bladder 3310 at the same time (not shown).

Figure 35:
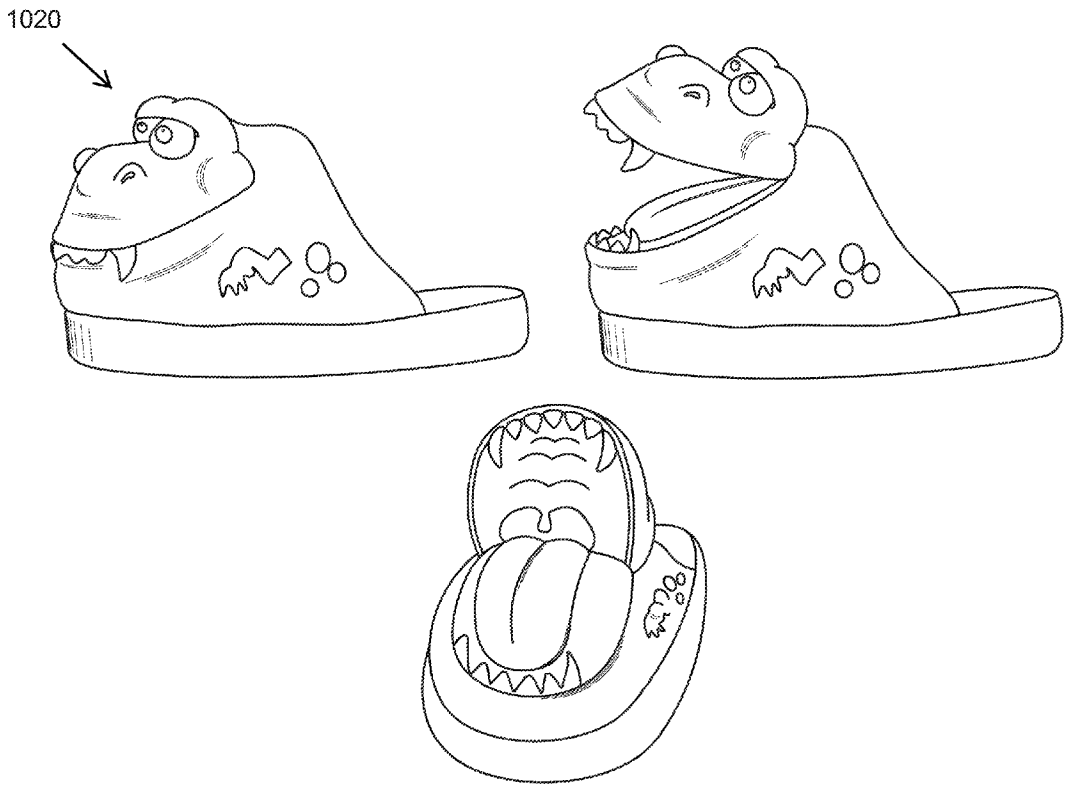
FIG. 35 through FIG. 37 are additional alternate embodiments.
Figure 36:
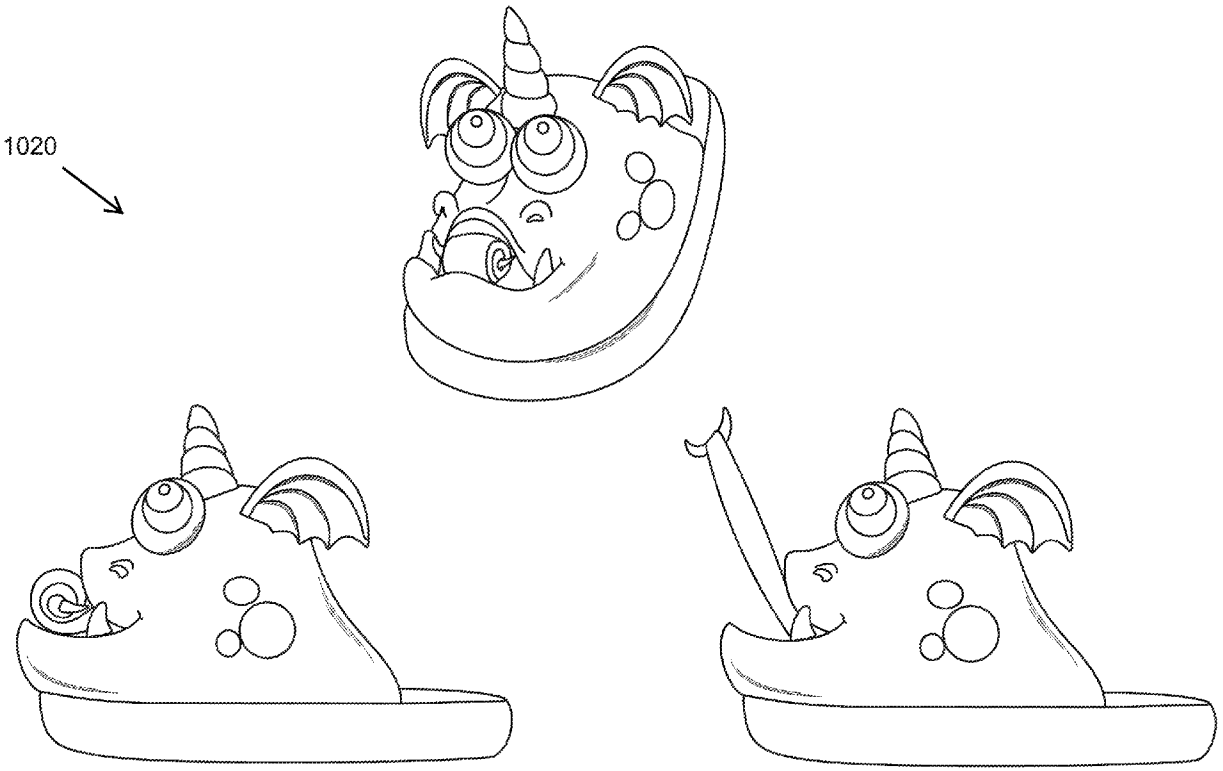
Figure 37:
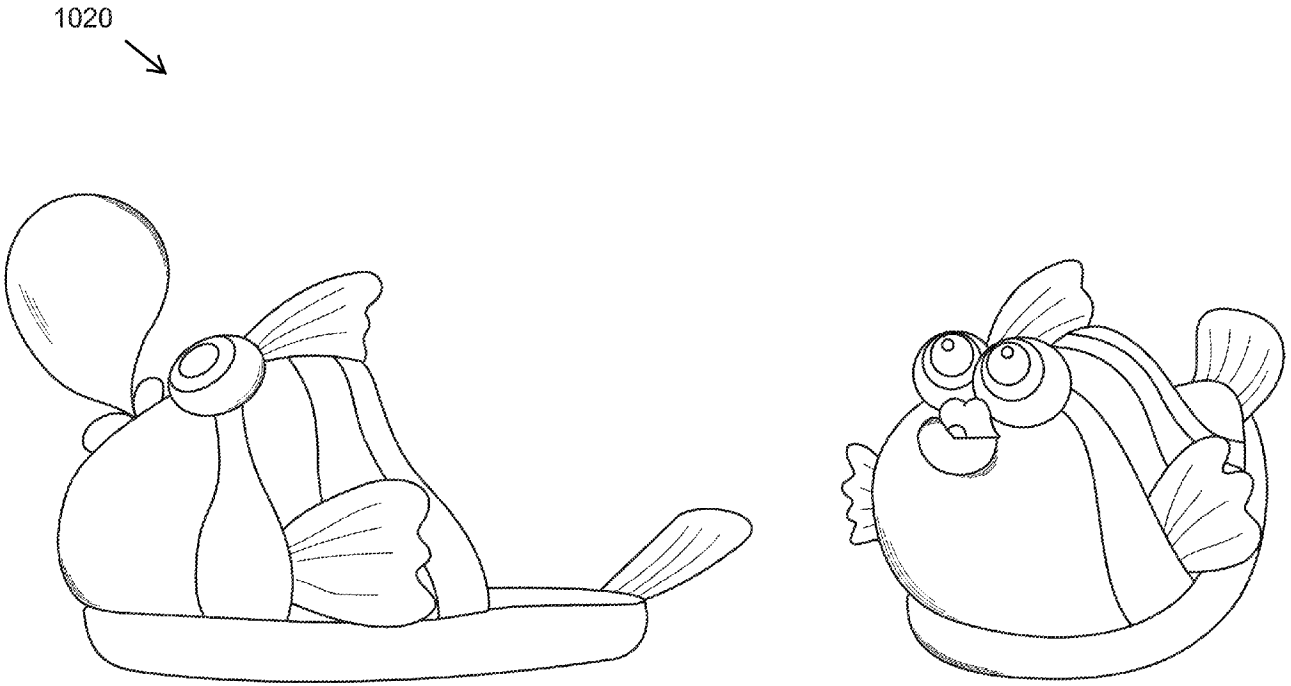

FIG. 35 through FIG. 37 are additional alternate embodiments for themed footwear articles. FIG. 35 illustrates unactuated and actuated modes for a fanciful dinosaur. The fanciful dinosaur uses a simulated mouth as an active element. The unactuated element has a mouth closed and the actuated element has the mouth opened.

FIG. 36 illustrates unactuated and actuated modes for a fanciful dragon. The fanciful dragon uses a simulated tongue as an active element. The unactuated element has the tongue coiled inside a mouth and the actuated element has tongue uncoiled extending out of the mouth.

FIG. 37 illustrates unactuated and actuated modes for a fanciful fish. The fanciful fish uses a simulated bubble as an active element. The unactuated element has the bubble deflated and hidden within a mouth and the actuated element has the bubble inflated and expanded outside of the mouth.

In the description herein, numerous specific details are provided, such as examples of components and/or methods, to provide a thorough understanding of embodiments of the present invention. One skilled in the relevant art will recognize, however, that an embodiment of the invention may be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention. A preferred embodiment of the present invention relates to definition of an independent air-powered assembly that may be incorporated into other devices for addition of active functionality. This assembly includes an air bladder or the like and one or more remote air-powered active elements communicated together by an elongate communication channel.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed is as new and desired to be protected by Letters Patent of the United States is:

1. An air-powered actuator system, comprising:

a first air cavity wherein said first air cavity includes a first capacity for a first quantity of air and includes an outlet permitting a portion of said first quantity of air to exit when said first air cavity is collapsed;

an air-actuated active element, remotely located relative to said first air cavity and having a generally clamshell-shaped configuration with a first portion, a second portion, and a hinging portion moveably coupling said first portion to said second portion wherein said first portion moves relative to said second portion about said hinging portion, including a second air cavity having a second capacity for a second quantity of air, said air-actuated active element including a closed mode having said second air cavity substantially deflated with said first portion folded over said second portion about said hinging portion and an opened mode having said second air cavity at least partially inflated with said first portion unfolded from over said second portion about said hinging portion, wherein said air-actuated active element is self-biased to said closed mode with said first portion and said second portion in a repeatable predetermined relative orientation to each other, wherein said air-actuated active element transitions from said closed mode to said opened mode responsive to air entering into said second air cavity; and a communication channel, coupled to said outlet and to said air-actuated active element, transferring said portion of air from said first air cavity towards said second air cavity to transition said air-actuated active element towards said opened mode responsive to said first quantity of air exiting said first cavity when said first air cavity is collapsed.

2. The air-powered actuator system of claim 1 further comprising a first biasing element returning said air-actuated active element to said closed mode after said portion of air has been transferred to said second air cavity.

3. The air-powered actuator system of claim 2 further comprising a valving structure disposed in fluid communication with said first air cavity, said valving structure open with respect to a transfer of a third quantity of air into said first air cavity from ambient air, said valving structure substantially inhibiting a transfer of said portion of air from said first air cavity to ambient air, and said valving structure enabling two-way air flow between said first cavity and said second cavity.

4. The air-powered actuator system of claim 3 further comprising a bleed vent disposed in fluid communication with said second air cavity, said bleed vent open with respect to a transfer of a fourth quantity of air out of said second air cavity.

5. The air-powered actuator system of claim 4 wherein said second air cavity is generally elongate when in said opened mode, said second air cavity having a proximal end and a distal end opposite of said proximal end, said distal end coupled to said communication channel and wherein said bleed vent is coupled to said distal end.

6. The air-powered actuator system of claim 1 further comprising a valving structure disposed in fluid communication with said first air cavity, said valving structure open with respect to a transfer of a third quantity of air into said first air cavity from ambient air, said valving structure substantially inhibiting a transfer of said portion of air from said first air cavity to ambient air, and said valving structure enabling two-way air flow between said first cavity and said second cavity.

7. The air-powered actuator system of claim 6 further comprising a first air bladder wherein said first air cavity is disposed within said first air bladder.

8. The air-powered actuator system of claim 6 wherein said communication channel includes a flexible elongate cannulated structure coupling said first air cavity to said air-actuated active element and wherein said valving structure is coupled to said flexible elongate cannulated structure.

9. The air-powered actuator system of claim 1 further comprising a bleed vent disposed in fluid communication with said second air cavity, said bleed vent open with respect to a transfer of a fourth quantity of air out of said second air cavity.

10. The air-powered actuator system of claim 9 wherein said second air cavity is generally elongate when in said opened mode, said second air cavity having a proximal end and a distal end opposite of said proximal end, said distal end coupled to said communication channel and wherein said bleed vent is coupled to said distal end.

11. The air-powered actuator system of claim 10 wherein said portion of said first quantity of air exceeds said second quantity of air by a delta quantity and wherein said bleed vent is configured so a portion of said delta quantity begins to escape through said bleed vent after said second air cavity is substantially inflated.

12. The air-powered actuator system of claim 1 further comprising an article of clothing to be worn by a person, wherein said article of clothing includes a theme having a motive element capable of a first configuration and a second configuration, wherein said first air cavity is disposed in a portion of said article of clothing actuable by said person and wherein said air-actuated active element is disposed within a moveable structure of the article of clothing associated with said motive element, with said air-actuated active element in said closed mode imparting said first configuration to said moveable structure and imparting in said opened mode said second configuration to said moveable structure.

13. The air-powered actuator system of claim 12 wherein said motive element includes one or more simulated structures selected from the group consisting of an eyelid, an eye, an ear, a mouth, a tongue, a paw, a hand, a wing, an limb, a bubble, a horn, a tail, a nose, a lidded container, a structure with a portal, a vehicle, a flower, a body part, a body appendage, an article of jewelry, and combinations thereof.

14. The air-powered actuator system of claim 12 wherein said article of clothing includes a footwear article to be worn on a foot of said person, said footwear article having a sole and an upper coupled to said sole for covering a portion of said foot, wherein said first air cavity is disposed within said sole and wherein said air-actuated active element is coupled to said upper.

15. The air-powered actuator system of claim 1 wherein said air-actuated active element includes a memory material formed into said closed mode wherein said air-actuated active element is self-biased to said closed mode without an additional discrete biasing element.

16. The air-powered actuator system of claim 1 wherein said first air cavity is provided within a collapsible and expandable structure and wherein said collapsible and expandable structure, said air-actuated active element, and said elongate communication channel all form an independent discrete assembly.

17. A footwear article, comprising:

a sole including a bladder defining a first air cavity wherein said first air cavity includes a first capacity containing a first quantity of air and said bladder includes an outlet enabling a portion of said first quantity of air to exit when said first air cavity is collapsed, said bladder automatically expanding when a bladder-compressing force is removed;

an upper, coupled to said sole, covering a portion of a foot of a wearer;

an air-actuated active element, coupled to said upper and having a generally clamshell-shaped configuration with a first portion, a second portion, and a hinging portion moveably coupling said first portion to said second portion, including a second air cavity having a second capacity for a second quantity of air, said air-actuated active element including a folded closed mode having said second air cavity substantially deflated and an unfolded opened mode having said second air cavity at least partially inflated, wherein said air-actuated active element transitions from said folded closed mode to said unfolded opened mode responsive to said portion of air entering into said second air cavity and wherein said air-actuated active element automatically transitions from said unfolded opened mode to said folded closed mode responsive to a self-folding closing bias material construction of said air-actuated active element; and a communication channel, coupled to said outlet and to said air-actuated active element, transferring said portion of air from said first air cavity towards said second air cavity.

18. An air-actuated amusement device, comprising:

an article of manufacture configured to be worn on a foot of a user, said article of manufacture having a collapsible sole, an upper coupled to said collapsible sole, and a fabric assembly coupled to said upper, said fabric assembly including an exterior wall having a first outside portion and a second outside portion with said fabric assembly having an unactuated mode and an actuated mode, said unactuated mode providing said fabric assembly overlying said article of manufacture displaying said first outside portion while concealing said second outside portion and said actuated mode providing said fabric assembly extending from said article of manufacture and displaying said second outside portion; and a discrete air-powered actuator assembly coupled to said article of manufacture, said discrete air-powered actuator assembling including:

a first air bladder disposed within said collapsible sole and having a first exterior wall containing a first bladder volume, said first exterior wall providing a first shape memory repeatedly inflating said first bladder volume after a collapse of said first bladder volume, said first bladder volume including a first capacity for a first quantity of air with said first air bladder including an outlet exiting a portion of said first quantity of air from said first bladder volume when said first exterior wall is collapsed;

a second air bladder coupled to both said upper and to said fabric assembly and having a generally clamshell-shaped configuration with a first portion disposed within said fabric assembly, a second portion outside said fabric assembly, and a hinging portion moveably coupling said first portion to said second portion, said second air bladder having a second exterior wall containing a second bladder volume, said second air bladder remotely located relative to said first air bladder, and said second bladder volume including a second capacity for a second quantity of air, said second discrete air bladder including a folded closed mode and an unfolded opened mode, said folded closed mode providing said second air bladder in a folded closed configuration having said first portion of said second air bladder overlaying said second portion of said second air bladder, said folded closed configuration defining a separation between said portions equal to a first distance with said second bladder volume at least partially deflated, and said unfolded opened mode providing said second air bladder in an unfolded opened configuration having said separation greater than said first distance and said second bladder volume at least partially inflated to said unfolded opened configuration, wherein an unfolding opening transition of said second air bladder from said folded closed mode to said unfolded opened mode transitions said fabric assembly from said unactuated mode to said actuated mode and wherein a folding closing transition of said second air bladder from said unfolded opened mode to said folded closed mode transitions said fabric assembly from said actuated mode to said unactuated mode; and a communication channel, coupled to said outlet and to said second air bladder, transferring air between said first air bladder and said second air bladder;

wherein said second air bladder is self-biased to said folded closed mode;

wherein said second air bladder unfolds from said folded closed configuration to said unfolded opened configuration responsive to air entering into said second bladder volume responsive in turn from air exiting from said first bladder volume; and wherein said second air bladder foldingly closes from said opened configuration to said folded closed configuration when air inflates said first bladder volume.

19. The air-actuated amusement device of claim 18 wherein said first portion is coupled to said upper and to said communication channel, and wherein said transitions of said second air bladder result from folding and unfolding movements of said second portion about said hinging portion.

20. The air-actuated amusement device of claim 18 wherein said fabric assembly is coupled to a forward portion of said upper at an attachment point, wherein said unactuated mode includes said fabric assembly overlaying said upper from said attachment point towards a front of said article of manufacture, and wherein said actuated mode reveals said second outside portion from a viewpoint forward of said front of said article of manufacture.

21. The air-actuated amusement device of claim 18 wherein said article of manufacture includes a characterization of a creature and wherein said fabric assembly includes a characterization of an appendage of said creature.

22. The air-actuated amusement device of claim 18 wherein said communication channel includes a flexible cannulated tube extending between said bladders.

23. The air-actuated amusement device of claim 18 wherein said biasing of said second air bladder includes said second exterior wall having a second shape memory configuring said second air bladder into said folded closed configuration, said second shape memory transitioning said second air bladder from said unfolded opened configuration to said folded closed configuration.

24. The air-actuated amusement device of claim 18 further including an air vent providing fluid communication from said first air bladder to ambient air surrounding said article of manufacture.

25. The air-actuated amusement device of claim 24 further including a one-way valve providing fluid communication from ambient air surrounding said article of manufacture into said first air bladder.

26. The air-actuated amusement device of claim 25 wherein said one-way valve is disposed in said elongate communication channel and includes a two-way channel communicating air transfer between said bladders.

27. The air-actuated amusement device of claim 26 wherein said second air bladder includes a bend portion disposed between said first and second portions, wherein said first portion is coupled to said upper and to said elongate air channel, and wherein said transitions of said second air bladder result from folding and closing movements of said second portion about said hinging portion.

28. The air-actuated amusement device of claim 27 wherein said fabric assembly is coupled to a forward portion of said upper at an attachment point, wherein said unactuated mode includes said fabric assembly overlaying said upper from said attachment point towards a front of said article of manufacture, and wherein said actuated mode reveals said second outside portion from a viewpoint forward of said front of said article of manufacture.

29. The air-actuated amusement device of claim 28 wherein said article of manufacture includes a characterization of a creature and wherein said fabric assembly includes a characterization of an appendage of said creature.

30. The air-actuated amusement device of claim 29 wherein said communication channel includes a flexible cannulated tube extending between said bladders.

31. An air-powered actuator system, comprising:

a first air bladder having a collapsible wall defining a first air cavity having a first capacity containing a first quantity of air, said first air bladder includes an outlet exiting a portion of said first quantity of air when said collapsible wall is collapsed;

an air-actuated active element, remotely located relative to said first air bladder and having a generally clamshell-shaped configuration with a first portion, a second portion, and a hinging portion moveably coupling said first portion to said second portion, having a flexible wall defining a second air cavity having a second capacity configured to contain a second quantity of air, said air-actuated active element including a folding closed mode having said second air cavity substantially deflated and an unfolded opened mode having said second air cavity at least partially inflated, wherein said air-actuated active element is self-biased to said folded closed mode, wherein said air-actuated active element transitions from said folded closed mode to said unfolded opened mode responsive to air entering into said second air cavity responsive in turn to said portion of said first quantity of air exiting from said outlet when said collapsible wall is collapsed and wherein said air-actuated active element automatically transitions from said unfolded opened mode to said folded closed mode; and a communication channel, coupled to said outlet and to said air-actuated active element, transferring said portion of air from said first air cavity towards said second air cavity which transitions said air-actuated active element towards said unfolded opened mode responsive to said first quantity of air exiting said first cavity when said first air cavity is collapsed.

32. The air-powered actuator system of claim 31 further comprising an air bleed system coupled to said communication channel wherein said air-actuated active element automatically transitions from said unfolded opened mode to said folded closed mode when said collapsible wall remains collapsed responsive to air exiting from said air-actuated active element through said air bleed system.

33. The air-powered actuator system of claim 32 wherein said air bleed system includes a bleed valve disposed in said air-actuated active element.

34. The air-powered actuator system of claim 31 further comprising an article of manufacture supporting said first air bladder and said air-actuated active element.

35. The air-powered actuator system of claim 34 further comprising a fabric assembly coupled to said article of manufacture, said fabric assembly including an exterior wall having a first outside portion and a second outside portion with said fabric assembly having an unactuated mode and an actuated mode, said unactuated mode providing said fabric assembly overlying said article of manufacture displaying said first outside portion while concealing said second outside portion and said actuated mode providing said fabric assembly extending from said article of manufacture and displaying said second outside portion.

36. The air-powered actuator system of claim 34 wherein said first air bladder is disposed inside a collapsible portion of said article of manufacture and wherein a portion of said air-actuated active element extends outside said article of manufacture.

37. The air-powered actuator system of claim 36 further comprising a fabric assembly coupled to said article of manufacture and covering said portion of said air-actuated active element that extends outside said article of manufacture, said fabric assembly including an exterior wall having a first outside portion and a second outside portion with said fabric assembly having an unactuated mode and an actuated mode, said unactuated mode providing said fabric assembly overlying said article of manufacture displaying said first outside portion while concealing said second outside portion and said actuated mode providing said fabric assembly extending from said article of manufacture and displaying said second outside portion.

38. The air-actuated amusement device of claim 18 further including a one-way valve providing fluid communication from ambient air surrounding said article of manufacture into said first air bladder.

39. The air-actuated amusement device of claim 38 wherein said one-way valve is disposed in said elongate communication channel and includes a two-way channel communicating air transfer between said bladders.

* * * * *